US009007414B2

(12) United States Patent
Hirano

(10) Patent No.: US 9,007,414 B2
(45) Date of Patent: Apr. 14, 2015

(54) IMAGE FORMING APPARATUS AND TEST IMAGE FORMING METHOD

(71) Applicant: Canon Kabushiki Kaisha, Tokyo (JP)

(72) Inventor: Masayuki Hirano, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/865,452

(22) Filed: Apr. 18, 2013

(65) Prior Publication Data

US 2013/0278703 A1 Oct. 24, 2013

(30) Foreign Application Priority Data

Apr. 20, 2012 (JP) ..... 2012-096802

(51) Int. Cl.
*B41J 2/47* (2006.01)
*G03G 15/00* (2006.01)
*G03G 15/043* (2006.01)

(52) U.S. Cl.
CPC ..... *G03G 15/55* (2013.01); *G03G 15/043* (2013.01)

(58) Field of Classification Search
USPC ..... 347/116, 229, 234, 240, 248, 251–254
See application file for complete search history.

(56) References Cited

U.S. PATENT DOCUMENTS

| | | | | |
|---|---|---|---|---|
| 6,236,417 | B1 * | 5/2001 | Fujii et al. | 347/129 |
| 6,972,783 | B2 | 12/2005 | Takamatsu et al. | |
| 7,006,119 | B2 * | 2/2006 | Takesue | 347/240 |
| 2010/0226672 | A1 * | 9/2010 | Ogasahara | 399/51 |
| 2011/0292461 | A1 * | 12/2011 | Kubo | 358/448 |

FOREIGN PATENT DOCUMENTS

| | | | | |
|---|---|---|---|---|
| JP | 2004009328 A | * | 1/2004 | B41J 2/44 |
| JP | 2004-341171 A | | 12/2004 | |

* cited by examiner

*Primary Examiner* — Hai C Pham
(74) *Attorney, Agent, or Firm* — Canon USA, Inc. IP Division

(57) ABSTRACT

Density unevenness is suppressed even in an image that is formed by a multiple exposures method in which the same region on a photoreceptor is exposed multiple times with different laser light sources (light emitting elements), by adjusting the amounts of light of the respective lasers based on a density difference among test images. An image is formed for each group of light emitting elements grouped together for multiple exposures by dividing, in the main scanning direction, the region of a test image formed on a recording medium. The images formed for the respective multiple-exposure light emitting element groups are compared to one another in density, to thereby adjust the amounts of light of the respective laser light sources (light emitting elements) and reduce fluctuations in image density.

6 Claims, 21 Drawing Sheets

IMAGE FORMING APPARATUS AND TEST IMAGE FORMING METHOD

BACKGROUND OF THE INVENTION

1. Field of the Invention

The present disclosure relates to an image forming apparatus for performing image forming processing by electrophotography.

2. Description of the Related Art

Laser beam printers, digital copiers, and other similar types of image forming apparatus are equipped with an optical scanning device. The optical scanning device forms an electrostatic latent image on a photoreceptor by, for example, reflecting laser light that is emitted from a laser diode on a polygon mirror that is rotating at a constant speed.

Optical scanning devices of recent years deal with printing speed enhancement and image resolution enhancement by multi-beam scanning technology in which a photoreceptor is scanned with a plurality of laser beams to form an image. This type of technology, which involves an increased number of laser beams, can enhance speed and resolution without raising the rotational speed of the polygon mirror or raising the picture clock as much as in, for example, a technology that enhances write speed by raising the rotational speed of the polygon mirror. The technology thus reduces problems caused by raising the rotational speed of the polygon mirror, such as a shortened motor lifetime, a raised motor temperature, and noise.

In multi-beam scanning, however, the width of image forming in one scan is wide along the sub-scanning direction. This makes density unevenness more visible due to beam pitch deviations in the sub-scanning direction and an optical face angle error of the polygon mirror, thereby deteriorating image quality.

One of methods of reducing density unevenness is to expose the same spot on a photoreceptor multiple times. In the following, the method of forming one pixel by multiple exposures to laser light is referred to as "multiple exposures method".

A known image forming apparatus that employs the multiple exposures method is disclosed in U.S. Pat. No. 6,972,783. This image forming apparatus forms one pixel by scanning the same spot on a photoreceptor with laser beams that have been reflected on different reflection planes of a polygon mirror. The image forming apparatus has an effect of reducing pitch irregularities by evening out cyclical positional deviation of components due to an optical face angle error of the polygon mirror, beam pitch deviations, and the like. Image forming with a plurality of laser beams is thus accomplished without deteriorating image quality.

On the other hand, the amount of light fluctuates from one laser beam to another in multi-beam scanning due to fluctuations in characteristics among a plurality of laser beams used. The resultant density unevenness in the image deteriorates the quality of the output image. A technology that could be a solution to this problem is disclosed in Japanese Patent Application Laid-open No. 2004-341171. This technology involves dividing the image region of a test image for checking fluctuations in light amount among laser beams, and forming images with a plurality of lasers separately, one laser at a time. Density unevenness is then determined for each laser beam and the amount of light is adjusted for each laser beam based on the result of the determination. The technology reduces density unevenness in the image in this manner.

For example, test image regions 2301 to 2304 of FIG. 23 which are created by dividing a test image for a plurality of laser beams A to D respectively are recorded on a recording medium 308 by conducting scanning for each laser beam as illustrated in FIG. 22. In this way, density unevenness is recognized easily from density comparison among the images formed by the lasers.

The technology of forming an image by the multiple exposures method, however, has the following problem.

The multiple exposures method forms a latent image on a photoreceptor with two lasers by exposing the same scanning spot on the photoreceptor twice with the use of different laser beams.

In an example illustrated in FIG. 24, a combination of a laser beam A and a laser beam E, a combination of a laser beam B and a laser beam F, a combination of a laser beam C and a laser beam G, and a combination of a laser beam D and a laser beam H are used for multiple exposures. FIGS. 25A and 25B are diagrams illustrating examples of a laser spot and the amount of laser light in multiple exposures that uses the laser beam A and the laser beam E. The two laser beams ideally scan the same scanning spot as illustrated in FIG. 25A. In actuality, scanning spots of the two lasers which are supposed to scan the same scanning spot on a photoreceptor may deviate from each other due to an optical face angle error of the polygon mirror or the like as illustrated in FIG. 25B. When the actual scanning spot deviates from ideal scanning, the amount of light drops by $\Delta P$. Consequently, the density of an image formed with the laser beam A and the laser beam E is low and appears as density unevenness on the image. It is therefore difficult in multiple exposures to satisfactorily correct density unevenness of an actual image by the conventional method in which only the densities of each test image that is formed with corresponding laser beam are referred to and are simply evened out.

SUMMARY OF THE INVENTION

An embodiment of the present invention has been made to solve the problems described above, and it is an object of an embodiment of the present invention to provide an image forming apparatus capable of reducing density unevenness in an image formed by multiple exposures without fail.

It is another object of an embodiment of the present invention to provide a method of forming a test image suitable for the reduction of the density unevenness.

An image forming apparatus according to an exemplary embodiment of the present invention includes an optical scanning device, an image forming unit, and a control unit. The optical scanning device includes a photoreceptor to be driven to rotate, a light source that includes a first light emitting element, which emits a first light beam, a second light emitting element, which emits a second light beam, a third light emitting element, which emits a third light beam, and a fourth light emitting element, which emits a fourth light beam. The optical scanning device further includes a deflection unit for deflecting the first light beam, the second light beam, the third light beam, and the fourth light beam so that the first light beam, the second light beam, the third light beam, and the fourth light beam scan the photoreceptor. In the optical scanning device, the first light beam and the third light beam are used to form, on the photoreceptor, first electrostatic latent images which correspond to the same pixel. Further, the second light beam and the fourth light beam are used to form, on the photoreceptor, second electrostatic latent images which correspond to the same pixel.

The image forming unit develops, with a toner, the first electrostatic latent images and the second electrostatic latent images formed on the photoreceptor by exposing the photoreceptor to the first light beam, the second light beam, the third light beam, and the fourth light beam, and transfers the toner images formed on the photoreceptor onto a recording medium.

The control unit controls the optical scanning device so that a first test image, which is created by developing the first electrostatic latent images and a second test image, which is created by developing the second electrostatic latent images, are formed in different places on the recording medium.

A test image forming method according to another exemplary embodiment of the present invention includes: forming first electrostatic latent images on a photoreceptor, which is driven to rotate, by a first light beam, which is emitted from a first light emitting element and a third light beam, which is emitted from a third light emitting element; forming second electrostatic latent images on the photoreceptor in a place different from a place where the first electrostatic latent images are formed, by a second light beam, which is emitted from a second light emitting element and a fourth light beam, which is emitted from a fourth light emitting element; developing, with a toner, the first electrostatic latent images and the second electrostatic latent images which are formed on the photoreceptor; and transferring, onto a recording medium, a first test image, which is created by developing the first electrostatic latent images, and a second test image, which is created by developing the second electrostatic latent images.

According to an embodiment of the present invention, fluctuations in the amount of light of each individual light emitting element or the like can be detected from a comparison between test images on a recording medium even in multiple exposures which use a plurality of light emitting elements. Density unevenness is thus reduced in an image formed by the image forming apparatus.

Further features of an embodiment of the present invention will become apparent from the following description of exemplary embodiments (with reference to the attached drawings).

DESCRIPTION OF THE EMBODIMENTS

Embodiments of the present invention are described in detail below.

First Embodiment

Figure 1:
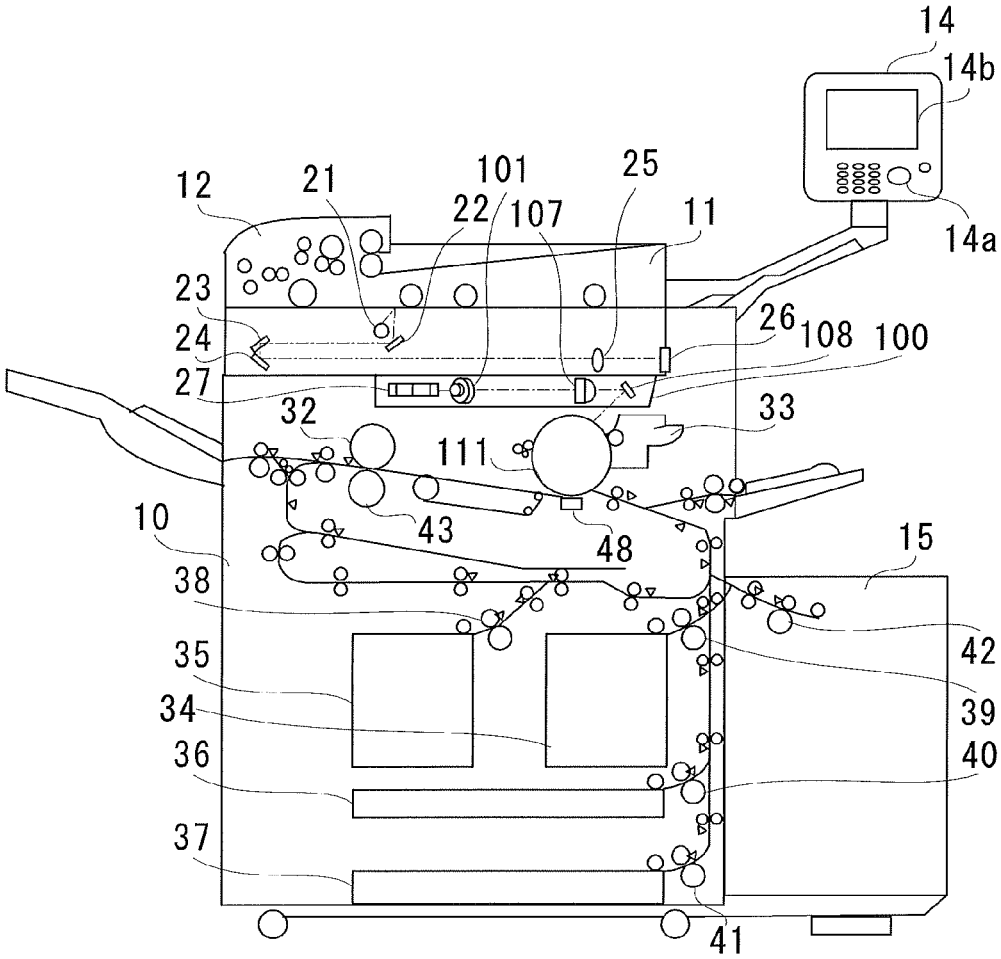
FIG. 1 is a structural diagram of an image forming apparatus according to a first embodiment of the present invention.

FIG. 1 is a structural diagram of an image forming apparatus according to a first embodiment of the present invention. This image forming apparatus includes a printer unit 10, which outputs an image of an original onto a recording medium such as recording paper, and a scanner unit 11, which reads data of the image of the original. An automatic original feeding mechanism 12 is provided on top of the scanner unit 11.

The image forming apparatus is operated by a user by setting a copy mode, a laser light amount adjustment mode, or the like via an operation unit 14. An operation button 14*a* is an input interface for operating the image forming apparatus. A display unit 14*b* of the operation unit 14 is capable of displaying various set values and current job status of the image forming apparatus. The display unit 14*b* is a touch panel and can handle, for example, an input of various types of data through touch operation on a display surface of the display unit 14*b*. The display unit 14*b* may also display a "call serviceman" message when a trouble occurs in the image forming apparatus, and display the location of a recording medium stuck inside the image forming apparatus when the recording medium is jammed.

The printer unit 10 is provided with a plurality of sheet feeding trays on which recording media can be stored, here, four sheet feeding trays denoted by 34, 35, 36, and 37. The user stores recording media sorted by size on their respective sheet feeding trays 34, 35, 36, and 37. A large-capacity paper deck 15 can be connected to the outside of the printer unit 10. The recording media are conveyed to a transfer unit by sheet feeding/conveying rollers 38, 39, 40, 41, and 42, which are driven by a motor (not shown).

In the scanner unit 11, an original put on a platen is irradiated with light from a light source 21, which can move in the left-right direction of FIG. 1. The irradiating light is reflected by the original, and an optical image thereof is formed in a charge coupled device (CCD) 26 through mirrors 22, 23, and 24 and a lens 25. The CCD 26 converts the formed optical image into electrical signals to generate digital image data. Image conversion processing such as enlargement and reduction can be performed on the digital image data as requested by the user. The image data processed by image conversion processing is stored in an image memory of a control unit (201), which is described later.

When outputting an image, the control unit (201) reads image data stored in the image memory, re-converts the read digital signals into analog image signals, and supplies the analog image signals to an optical scanning device 100. The optical scanning device 100 scans a photosensitive drum 111 by irradiating the photosensitive drum 111 via a scanner 27, a lens 107, and a mirror 108 with laser light that is emitted from a semiconductor laser 101 in accordance with the supplied analog image signals. The scanner 27 is constituted of a polygon mirror and a scanner motor which drives the polygon mirror.

The photosensitive drum 111 is a photoreceptor that has on its surface a photoconductive layer made of an organic photoconductor. The photosensitive drum 111 is driven to rotate at a constant speed during a copy job. The surface of the photosensitive drum 111 is scanned with laser light, to thereby form a latent image. The latent image formed on the surface of the photosensitive drum 111 is turned into a visible image (toner image) when a toner from a developing unit 33 adheres to the latent image.

A recording medium is carried along an original conveying path from one of the sheet feeding trays 34, 35, 36, and 37 and passes under the photosensitive drum 111 in synchronization with the visible image on the surface of the photosensitive drum 111. At this point, the visible image on the surface of the photosensitive drum 111 is transferred to the recording medium by a transfer charger 48. The transferred visible image is an unfixed image which is yet to be fixed onto the recording medium. The recording medium bearing the unfixed image is conveyed to a space between a fixing roller 32 and a pressurizing roller 43. The unfixed image is fused and fixed onto the recording medium by the fixing roller 32 and the pressurizing roller 34. The recording medium having the image fixed thereon is discharged out of the printer unit 10.

Figure 2:
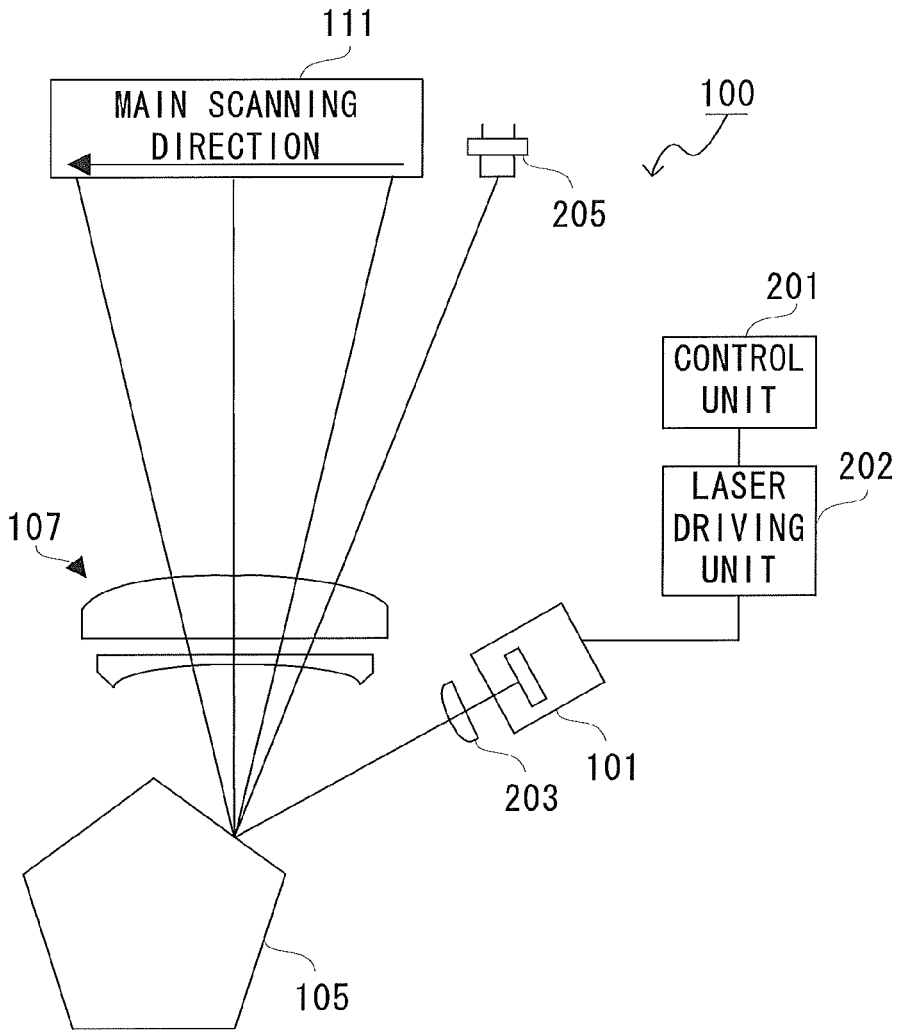
FIG. 2 is a structural diagram of an optical scanning device.
Figure 3:
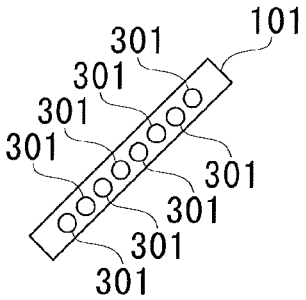
FIG. 3 is a diagram that gives an exemplification of laser light sources (light emitting elements).

FIG. 2 is a structural diagram of the optical scanning device 100. FIG. 3 is a diagram that gives an exemplification of laser sources (light emitting elements) in the optical scanning device 100.

Figure 24:
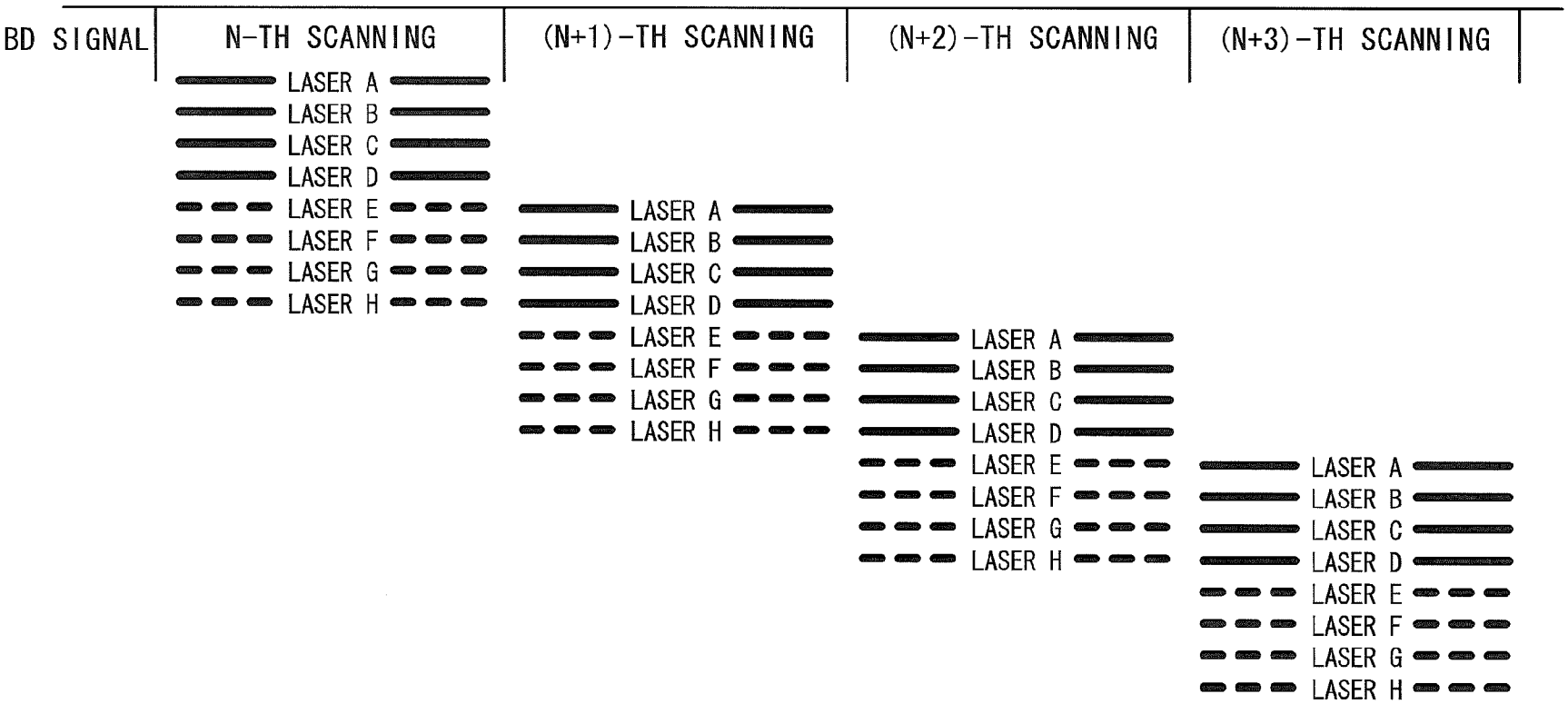
FIG. 24 is a diagram that gives an exemplification of scanning of test image regions.
Figure 25A:
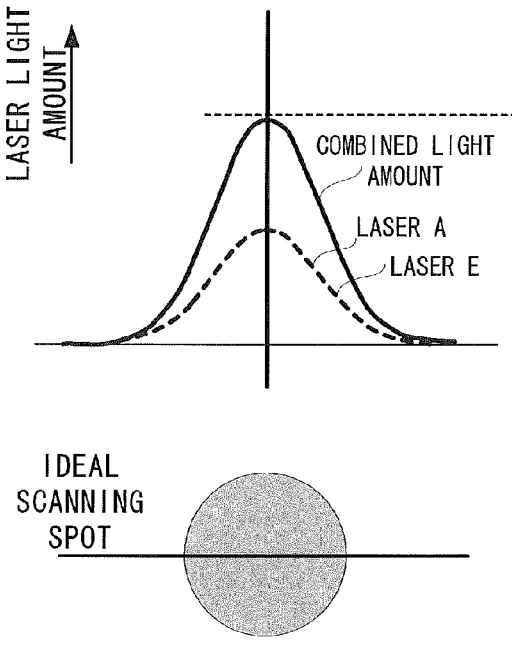
FIG. 25A, FIG. 25B are graphs showing an example of a relation between the amounts of light of respective lasers and a combined amount of light that is obtained by combining the amounts of laser light.
Figure 25B:
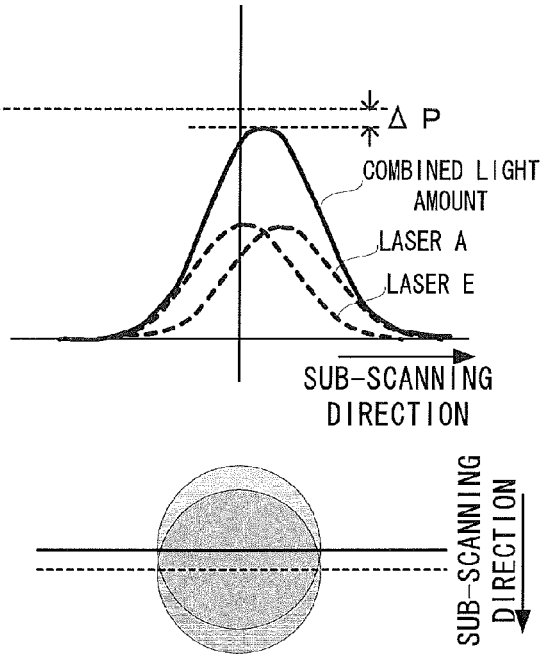

The optical scanning device 100 generates a laser driving signal in a laser driving unit 202, which receives an image signal from the control unit 201. Based on the laser driving signal generated in the laser driving unit 202, the optical scanning device 100 emits laser light from the semiconductor laser 101. As illustrated in FIG. 3, the semiconductor laser 101 includes a plurality of light emitting elements 301 each of which emits a laser beam. Laser beams from the plurality of laser light sources (light emitting elements) 301 are combined in multiple exposures to expose the photosensitive drum 111 multiple times. Specifically, in the image forming apparatus of this embodiment, a spot (scanning line) scanned with laser beams E, F, G, and H in the N-th scan is scanned with laser beams A, B, C, and D in the (N+1)-th scan as illustrated in FIG. 24. The plurality of light emitting elements are arranged so that laser beams emitted from the plurality of light emitting elements each form an image in a different spot in the rotation direction of the photosensitive drum 111. Alternatively, the plurality of light emitting elements may be arranged so that laser beams emitted from the plurality of light emitting elements form images in the same spot in the rotation direction of the photosensitive drum 111.

Laser light emitted from the semiconductor laser 101 is turned into collimated beams by a collimator lens 203, and the collimated beams enter a polygon mirror 105, which constitutes a part of the scanner 27. The polygon mirror 105 is rotated at a constant angular speed by a scanner motor (not shown), and laser light incident on the polygon mirror 105 is deflected by the polygon mirror 105. The laser light deflected by the polygon mirror 105 is converted by the lens 107, which is an f-θ lens or the like, into laser beams that scan the photosensitive drum 111 at a constant speed. A beam detect (BD) sensor 205 detects laser light deflected by the polygon mirror 105. In response to the reception of laser light, the BD sensor 205 generates a BD signal which is a horizontal synchronization signal for synchronizing the rotation of the polygon mirror 105 with image signals.

Figure 4:
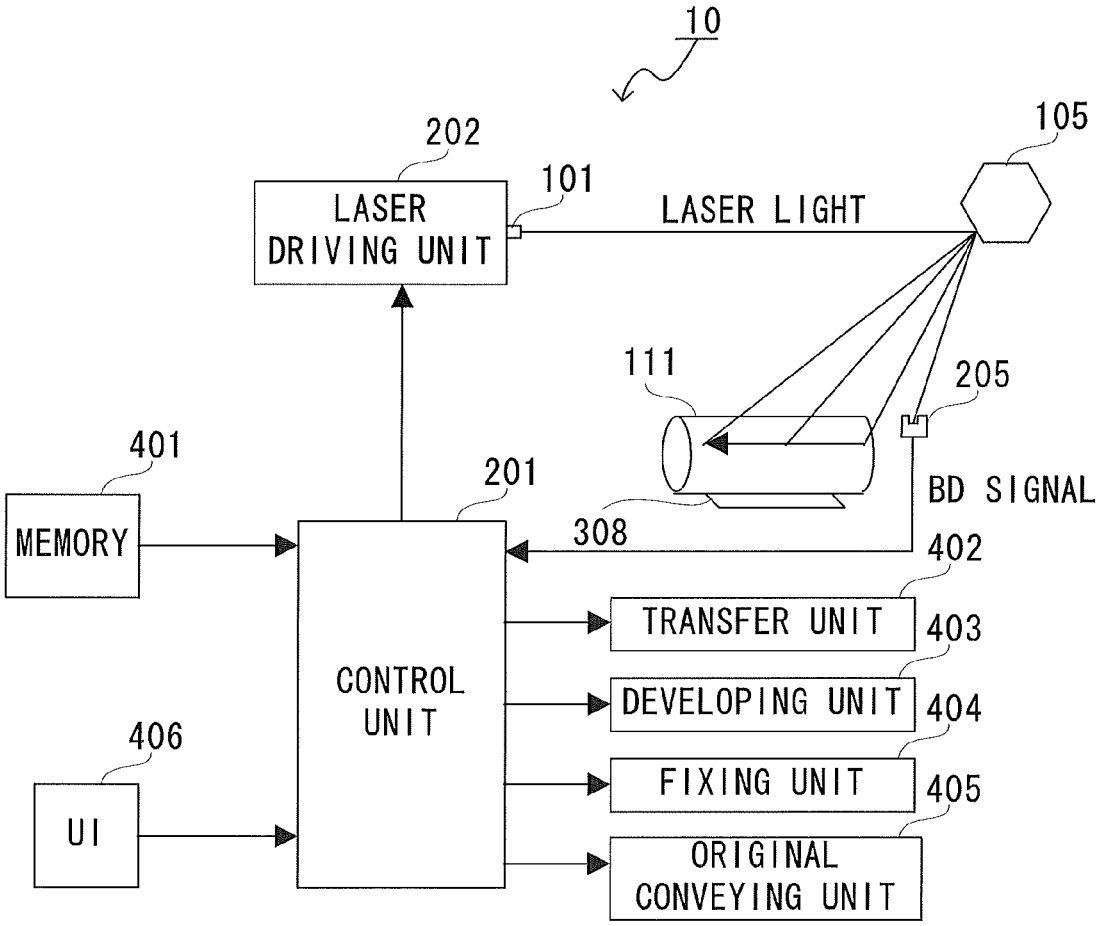
FIG. 4 is a block diagram illustrating the structure of a printer unit.

FIG. 4 is a block diagram illustrating the structure of the printer unit 10 of the image forming apparatus.

The control unit 201 generates image signals of a normal image or a test image, which is described later, and supplies the image signals to the laser driving unit 202. A memory 401 stores target light amount values which indicate target light amounts of the respective light emitting elements 301. The control unit 201 reads target light amount values of the respective light emitting elements 301 out of the memory 401 and sets the read values in the laser driving unit 202. Laser beams emitted from the respective light emitting elements 301 are adjusted in the amount of light in this manner.

Figure 5:
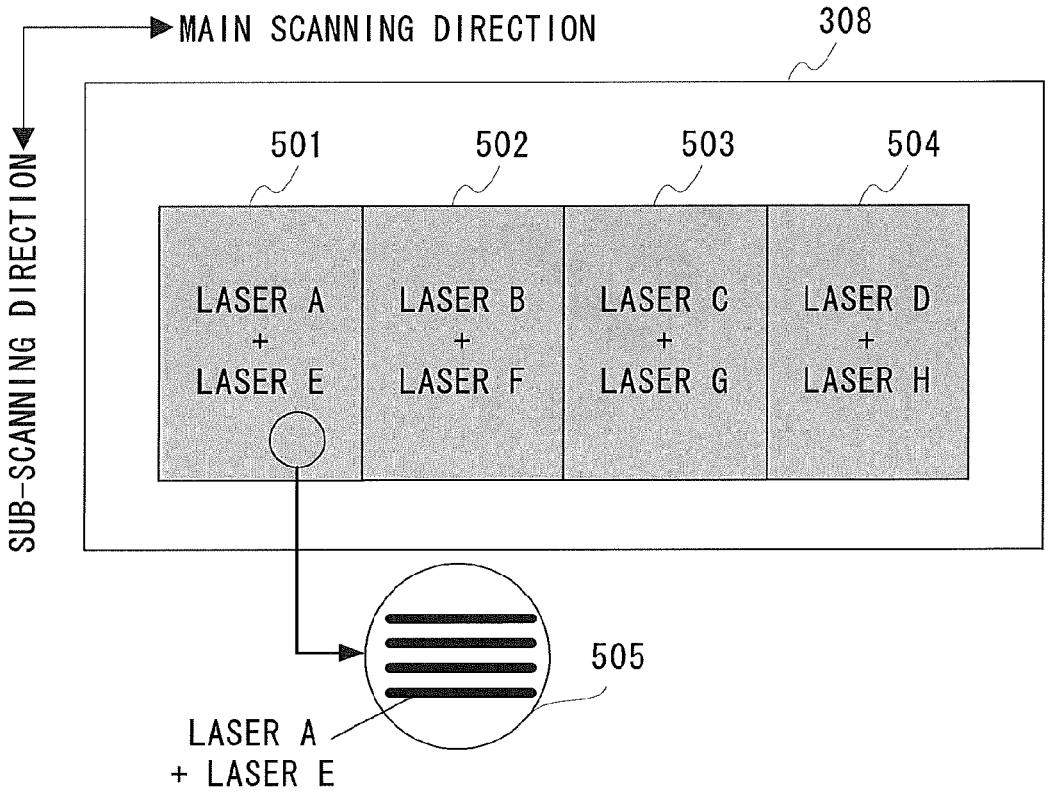
FIG. 5 is a diagram that gives an exemplification of a test image.

FIG. 5 is a diagram illustrating an example of a test image for checking density unevenness due to the laser light sources (light emitting elements) 301.

The test image is divided into four in the main scanning direction in relation to the recording medium 308, specifically, into test image regions 501, 502, 503, and 504.

The light emitting elements 301 in this embodiment are respectively referred to as laser beams A to H in order to distinguish one from another. In this embodiment, a combination of the laser beam A and the laser beam E, a combination of the laser beam B and the laser beam F, a combination of the laser beam C and the laser beam G, and a combination of the laser beam D and the laser beam H are used to expose the same region on the photosensitive drum 111 multiple times.

The test image region 501 (first test image) is made up of a plurality of scanning lines as illustrated in an enlarged view 505. The scanning lines are formed by exposure that uses the laser beam A (laser light from a first light emitting element) and the laser beam E (laser light from a third light emitting element). Similarly, scanning lines in the test image region 502 (second test image) are formed by exposure that uses the laser beam B (laser light from a second light emitting element) and the laser beam F (laser light from a fourth light emitting element). Scanning lines in the test image region 503 are formed by exposure that uses the laser beam C and the laser beam G. Scanning lines in the test image region 504 are formed by exposure that uses the laser beam D and the laser beam H.

Figure 6:
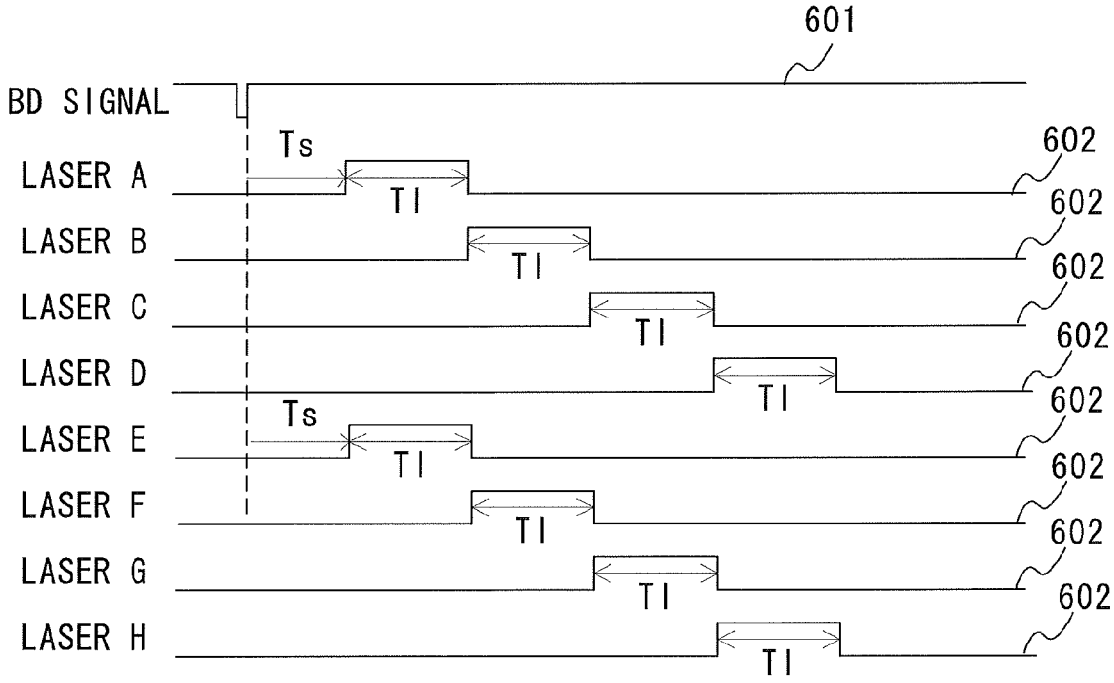
FIG. 6 is a timing chart for forming a test image.

FIG. 6 is a timing chart for forming the test image illustrated in FIG. 5. This timing chart illustrates the relation of light emission 602 of each laser to a BD signal 601 that is observed when the test image is formed.

The control unit 201 turns on the laser beam A and the laser beam E after a time Ts elapses since the input of the BD signal 601. When a time Tl further elapses, the control unit 201 turns off the laser beam A and the laser beam E and, at the same time, turns on the laser beam B and the laser beam F. When the time Tl elapses subsequently, the control unit 201 turns off the laser beam B and the laser beam F and, at the same time, turns on the laser beam C and the laser beam G. When another time Tl elapses, the control unit 201 turns off the laser beam C and the laser beam G and, at the same time, turns on the laser beam D and the laser beam H. After the subsequent elapse of the time Tl, the control unit 201 turns off the laser beam D and the laser beam H. The control unit 201 executes the control described above for the duration of a plurality of scanning cycles, thereby forming the test image.

Figure 7:
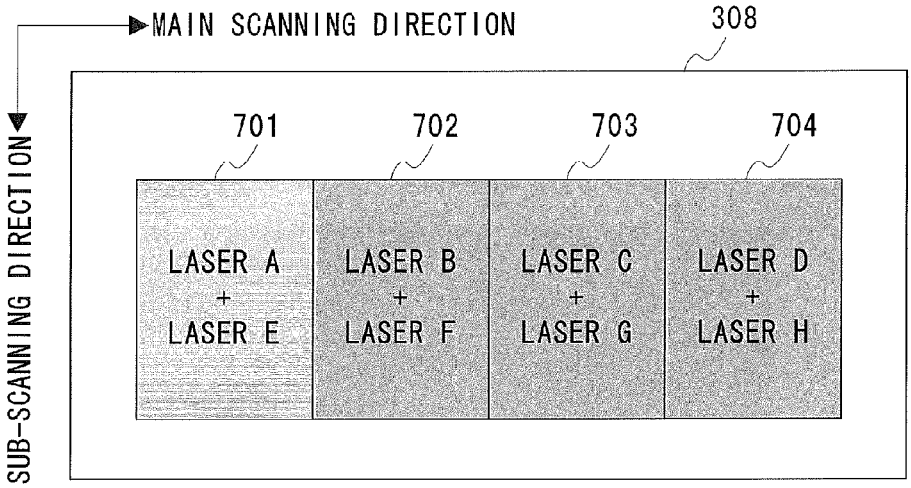
FIG. 7 is a diagram that gives an exemplification of a test image.
Figures 8A, 8B, 8C:
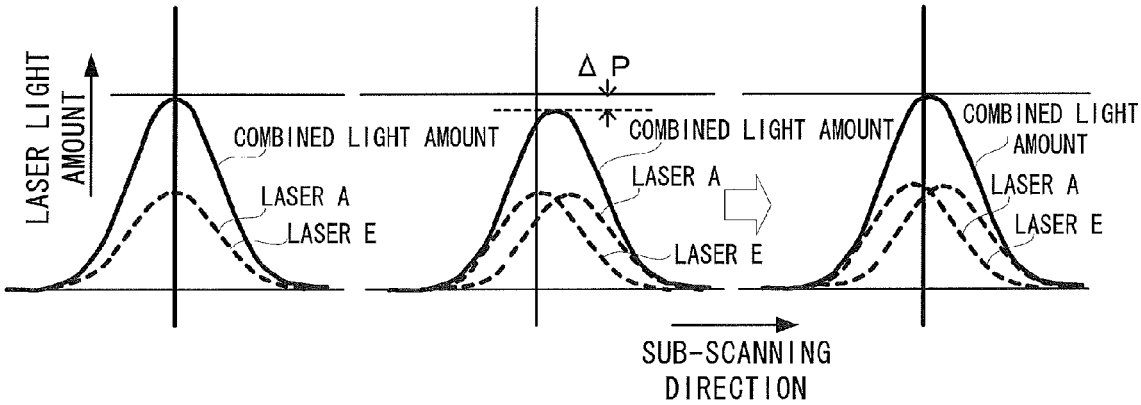
FIG. 8A, FIG. 8B, FIG. 8C are graphs showing an example of a relation between the amounts of light of respective lasers and a combined amount of light that is obtained by combining the amounts of laser light.
Figure 9:
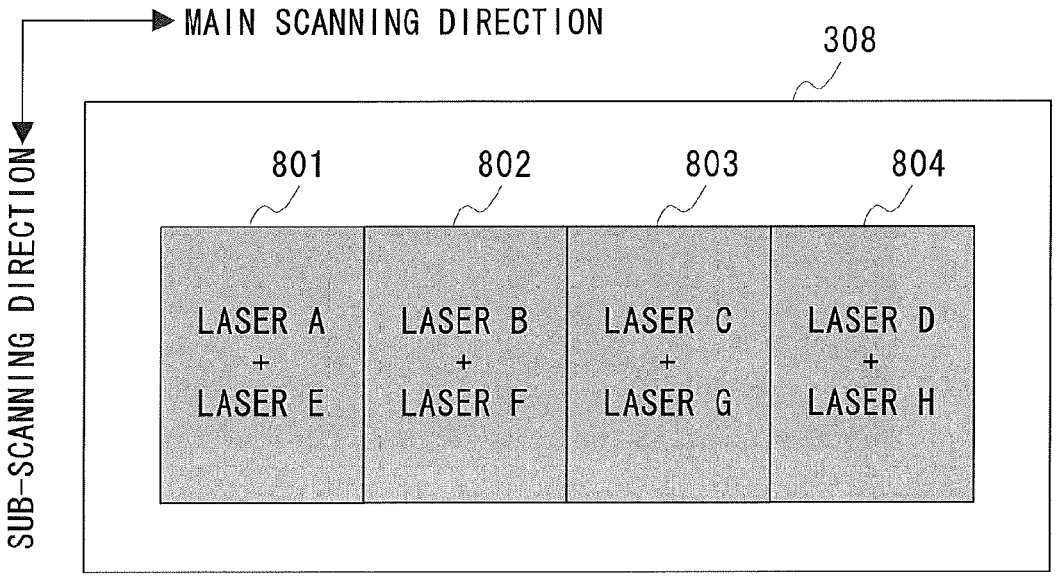
FIG. 9 is a diagram that gives an exemplification of a test image.

FIG. 7 illustrates an example of another test image. FIG. 8A, FIG. 8B, and FIG. 8C are graphs showing an example of a relation, in the formation of a test image, between the amounts of light of respective lasers and a combined amount of light that is obtained by combining the amounts of laser light. FIG. 9 illustrates an example of a test image in which set values of the amounts of laser light have been corrected.

The test image in the example of FIG. 7 has density unevenness. Specifically, an image of a test image region 701 is lower in density than images of other test image regions 702 to 704. This is caused by, for example, the scanning spot that deviates in the sub-scanning direction when multiple exposures that uses the laser beam A and the laser beam E is conducted as illustrated in FIG. 8B. Specifically, the image density is low in the test image region 701 alone because the combined amount of light of the laser beam A and the laser beam E is smaller than the ideal combined amount of light by ΔP due to the scanning spot deviation.

FIG. 8A illustrates ideal multiple exposures in which the laser beam A and the laser beam E scan the same scanning line. FIG. 8C is an example in which the combined amount of light has risen to an ideal level as a result of correcting the set values of the light amounts of the laser beam A and the laser beam E. Correcting the set values of the light amounts of laser light eliminates density unevenness in a test image as illustrated in FIG. 9.

An example of a method of forming the test image of FIG. 5 is described next.

Figure 10:
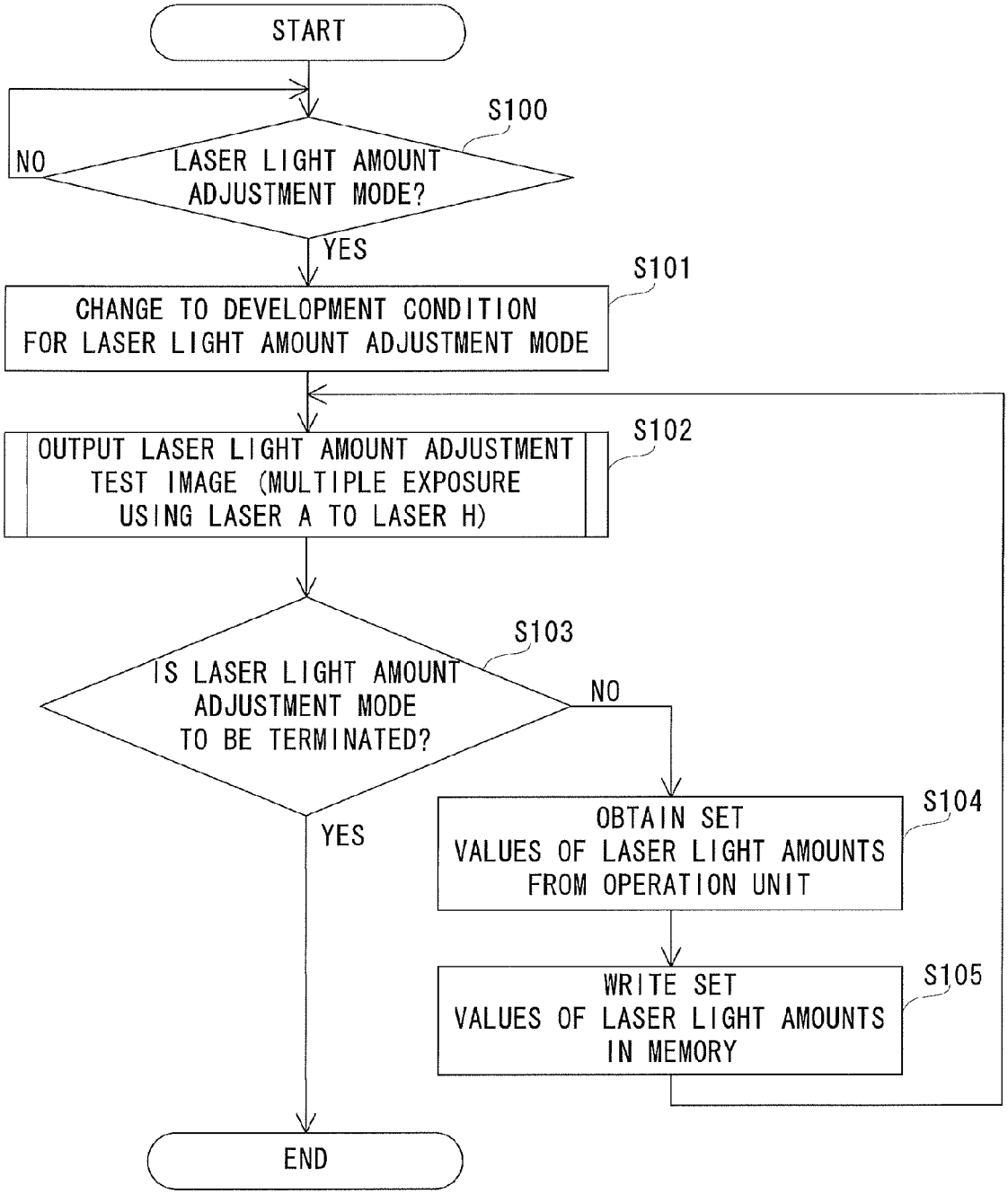
FIG. 10 is a flow chart for a procedure of adjusting the amount of laser light.

FIG. 10 is an explanatory diagram illustrating an example of a procedure of forming a test image.

The control unit 201 first determines whether or not the user has operated the operation unit 14 to select the laser light amount adjustment mode (Step S100). In the case where the laser light amount adjustment mode has been selected (Step S100: Y), the control unit 201 changes development conditions, which are described later, for the laser light amount adjustment mode (Step S101). The control unit 201 then executes processing of outputting a laser light amount adjustment test image (multiple exposures with the use of the laser beam A to the laser beam H) (Step S102). Thereafter, the control unit 201 determines whether or not terminating the laser light amount adjustment mode has been selected (Step S103). In the case where the laser light amount adjustment mode is to be terminated (Step S103: Y), the control unit 201 ends the laser light amount adjustment mode.

In the case where terminating the laser light amount adjustment mode has not been selected (S103: N), laser light amount set values are obtained from the operation unit 14 (S104). The control unit 201 writes the obtained set values of the laser light amounts in the memory 401 and proceeds to Step S102 (Step S105).

Whether to end the laser light amount adjustment mode is determined by the user by, for example, visually checking a test image printed on the recording medium 308. The user chooses to terminate the laser light amount adjustment mode when the density is uniform throughout the images of the respective regions of the test image as in FIG. 9, for example. In the case where the density is not uniform throughout the images of the respective regions of the test image as in FIG. 7, the user chooses to continue the laser light amount adjustment mode. When the laser light amount adjustment mode is to continue, the user uses the operation unit 14 to change the set values of the amounts of light of the respective laser beams in accordance with the densities of the images of the respective regions of the test image.

Described next is an example of changing set values of the amounts of light of the respective laser beams in the operation unit 14.

Figure 11:
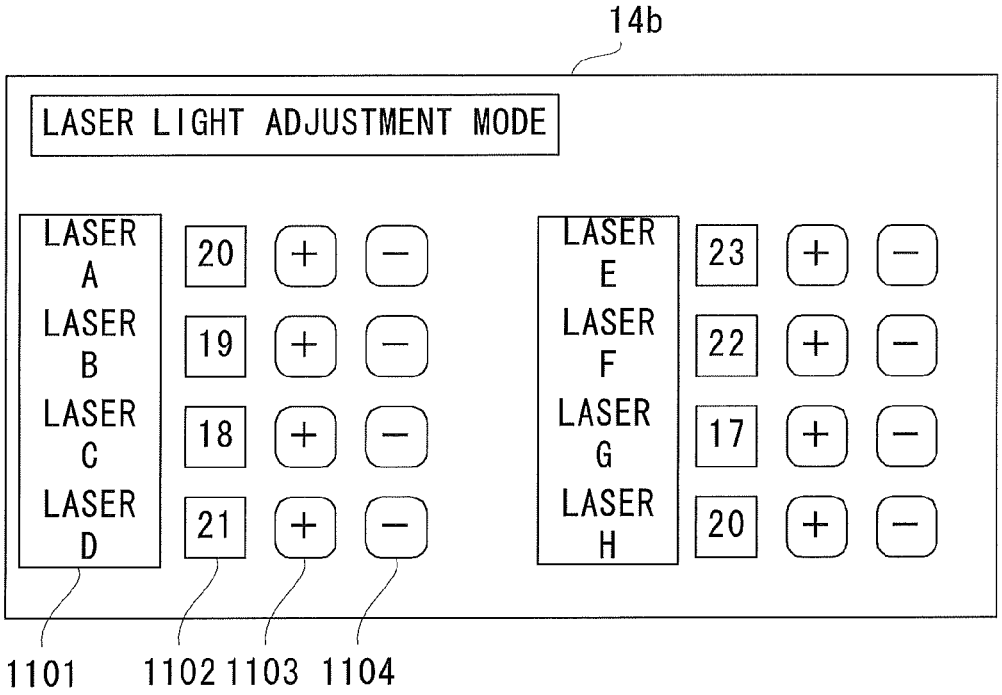
FIG. 11 is a diagram that gives an exemplification of what is displayed on a display unit in a laser light adjustment mode.

FIG. 11 illustrates a display example of the display unit 14*b* of the operation unit 14. The display unit 14*b* allows touch operation on the touch panel. The display unit 14*b* in the illustrated example is provided with a laser name list display portion 1101, set value display portions 1102 for the respective lasers, and set value adjusting buttons 1103 and 1104 for the respective lasers. Pressing the set value adjusting buttons 1103 for the respective lasers increases set values in the display portions 1102 by 1. Pressing the set value adjusting buttons 1104 for the respective lasers decreases set values in the display portions 1102 by 1. The set values of the respective lasers are reflected as the amounts of light of the respective laser beams.

In the case where the display unit 14*b* is not a touch panel, set values in the set value display portions 1102 are changed with the use of the operation button 14*a*.

Figure 12:
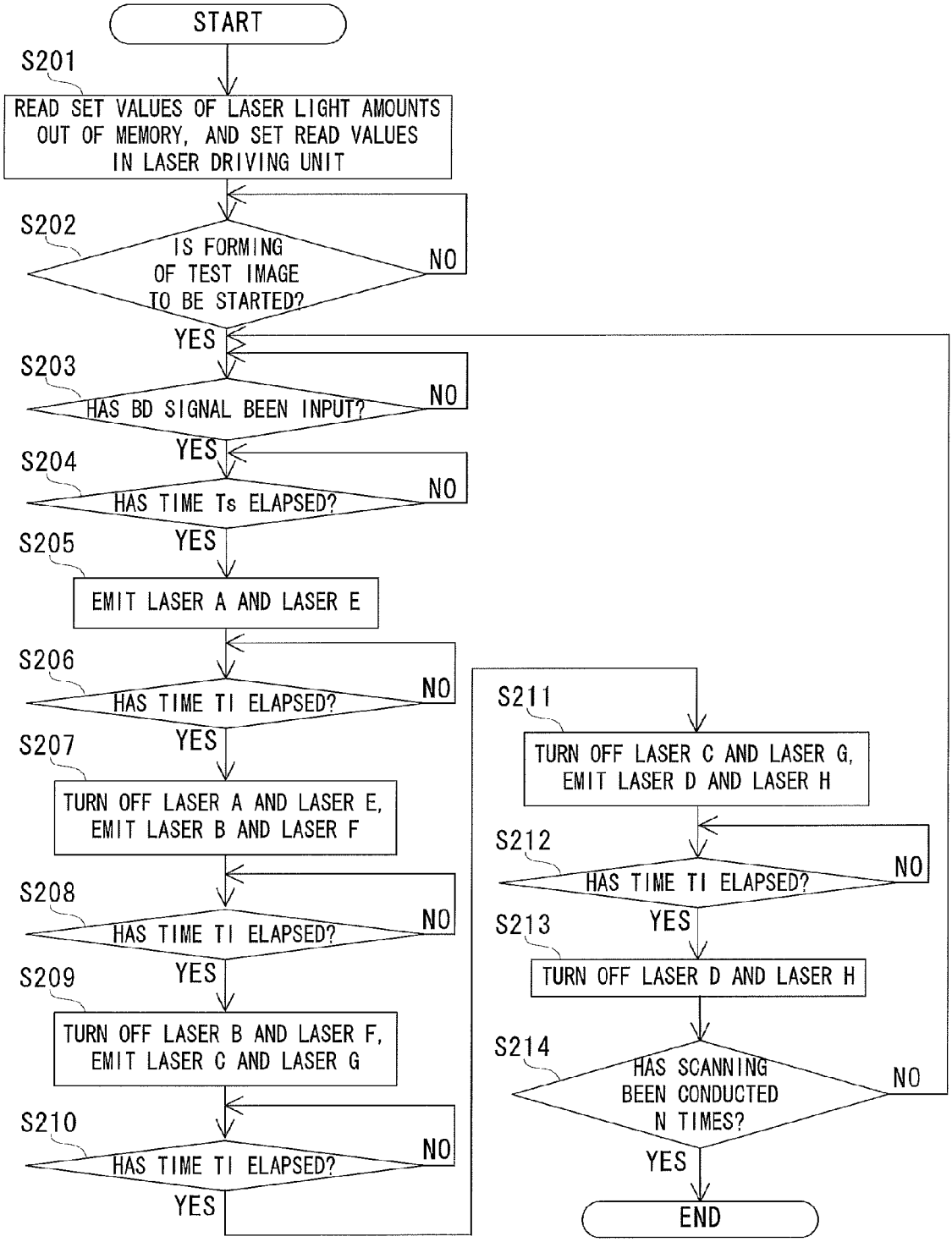
FIG. 12 is a flow chart for processing of outputting a laser light adjustment test image.

Described next with reference to FIG. 12 is a procedure example of the processing of outputting a laser light amount adjustment test image (multiple exposures with the use of the laser beam A to the laser beam H) of Step S102.

The control unit 201 first reads set values of the amounts of laser light out of the memory 401 and sets the read values in the laser driving unit 202 (Step S201). The control unit 201 next determines whether to start the forming of a test image (Step S202). In the case where the image forming is to be started (Step S202: Y), the control unit 201 waits for an input of a BD signal from the BD sensor 205 (Step S203). When a BD signal is input (Step S203: Y) and after the time Ts elapses (Step S204: Y), the laser beam A and the laser beam E are emitted out of the plurality of lasers (Step S205).

Thereafter, the control unit 201 waits for the elapse of the time Tl (Step S206: Y), and switches the emitting lasers by turning off the laser beam A and the laser beam E so that the laser beam B and the laser beam F are emitted (Step S207). The control unit 201 subsequently waits for the elapse of another time Tl (Step S208: Y), and turns off the laser beam B and the laser beam F so that the laser beam C and the laser beam G are emitted (Step S209). The control unit 201 further waits for the elapse of the time Tl (Step S210: Y), and switches the emitting lasers by turning off the laser beam C and the laser beam G so that the laser beam D and the laser beam H are emitted (Step S211). The control unit 201 once again waits for the elapse of the time Tl (Step S212: Y), and turns off the laser beam D and the laser beam H (Step S213).

One scan is thus conducted.

The control unit 201 determines whether or not the image processing apparatus has finished conducting scanning N times (Step S214). For instance, when the sub-scanning size of the test image is equivalent to 200 scans, N is "200". In the case where the image processing apparatus has not finished conducting scanning N times (Step S214: N), the control unit 201 returns to Step S203 to execute Steps S203 to S213, and further executes scanning processing.

In the case where the image processing apparatus has finished conducting scanning N times (Step S214: Y), the processing of outputting a laser light amount adjustment test image (multiple exposures with the use of the laser beam A to the laser beam H) of Step S102 is finished.

The test image is formed in the manner described above. The user corrects the amounts of light of the respective lasers by viewing the output test image.

Second Embodiment

A second embodiment of the present invention is described next. In the second embodiment, test images are formed by single exposure that uses each laser beam separately (sub-test images) at the same time as the test image of the first embodiment which is formed by multiple exposures. This embodiment allows not only comparison among test images formed by multiple exposures but also comparison among test images formed by single exposure that uses each laser beam separately (sub-test images). Therefore, by uniformizing the amount of light in multiple exposures and simultaneously reducing the light amount difference among laser beams based on a comparison in the amount of light between lasers, the difference in lifetime among laser beams due to the difference in the amount of light of the laser beams can be reduced.

Figure 13:
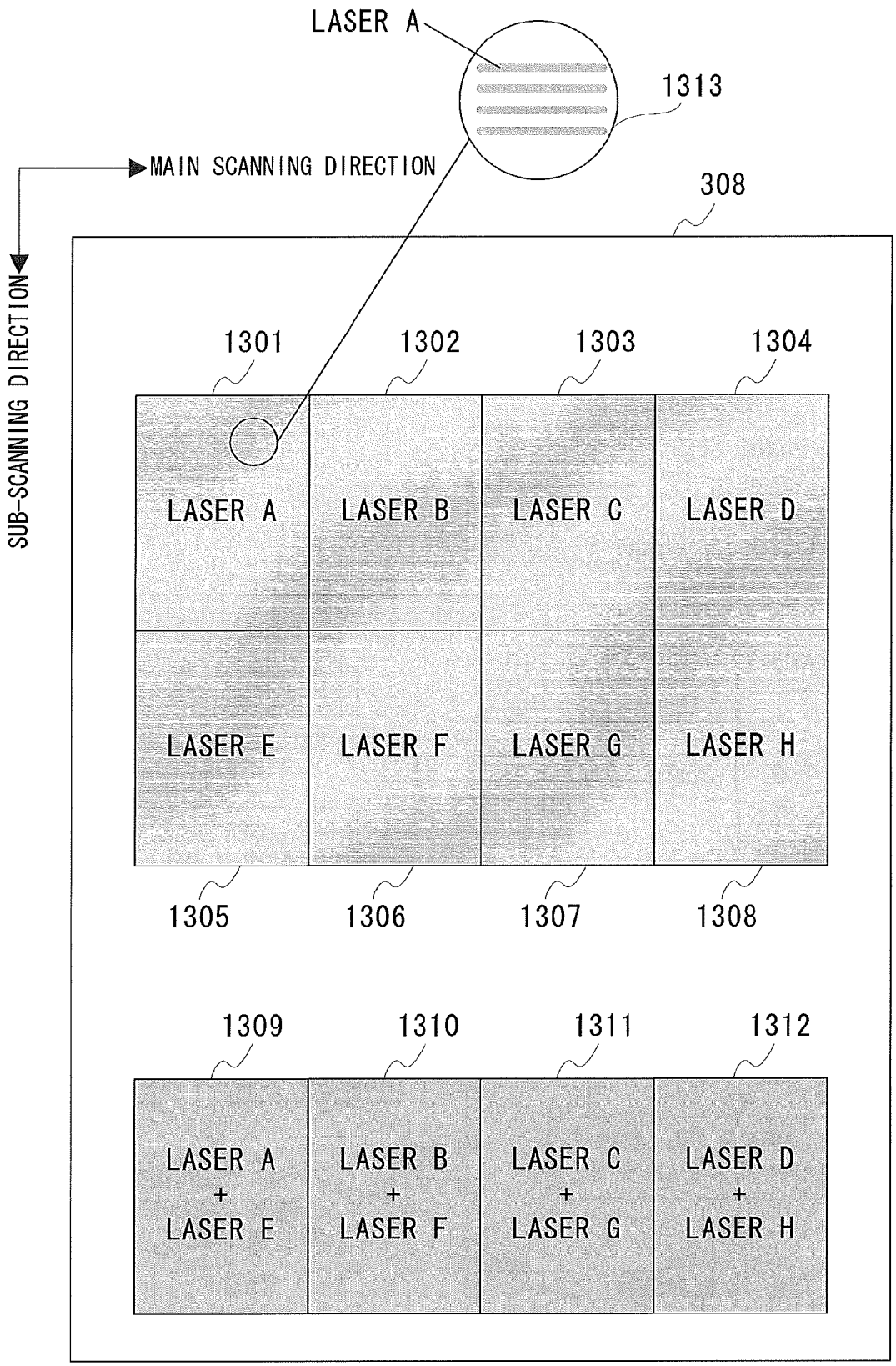
FIG. 13 is a diagram that gives an exemplification of a test image.

FIG. 13 is a diagram illustrating an example of a test image according to this embodiment in which images formed by single exposure that uses each laser beam separately and images formed by multiple exposures are formed simultaneously.

On the recording medium 308, an image is formed in a test image region 1301 by single exposure that uses the laser beam A as illustrated in an enlarged view 1313. Similarly, images are formed in test image regions 1302 to 1308 by single exposure by using the laser beam B to the laser beam H, respectively. Test image regions 1309, 1310, 1311, and 1312, on the other hand, are test images formed by multiple exposures with the use of the laser beam A to the laser beam H. The test images formed by multiple exposures are the same as those in the first embodiment.

Figure 14A:
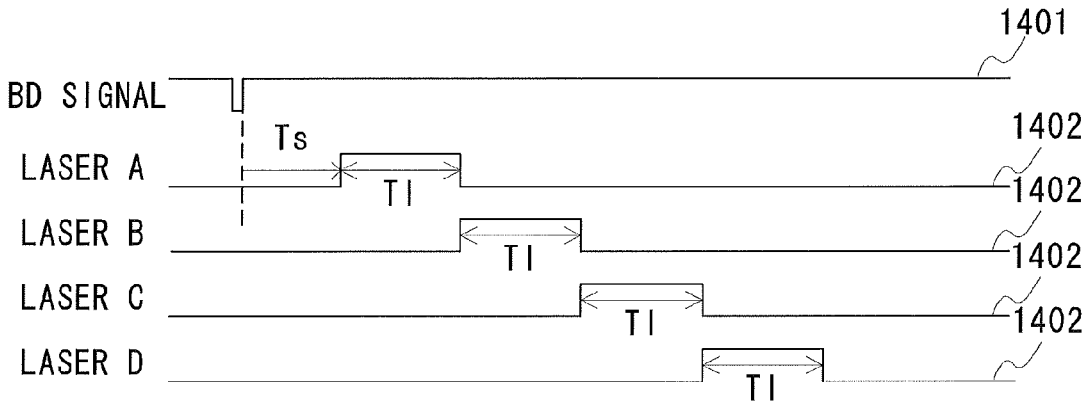
FIG. 14A, FIG. 14B, FIG. 14C are timing charts for forming a test image.
Figure 14B:
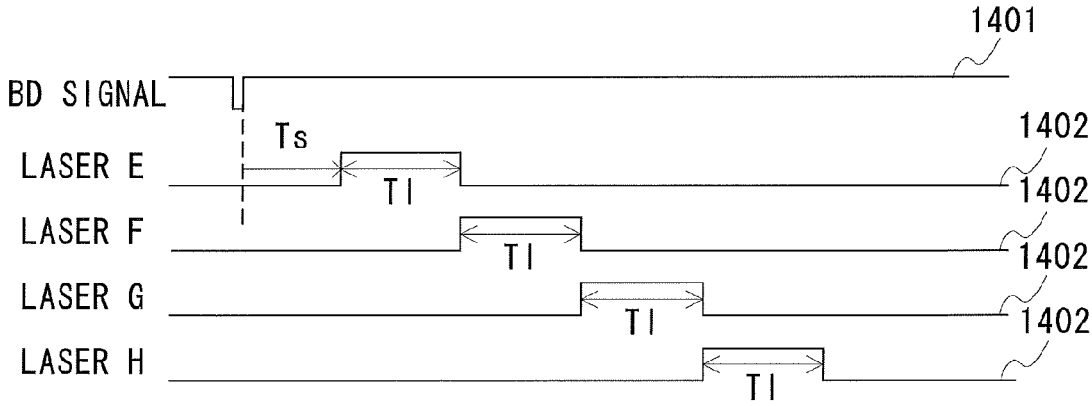
Figure 14C:
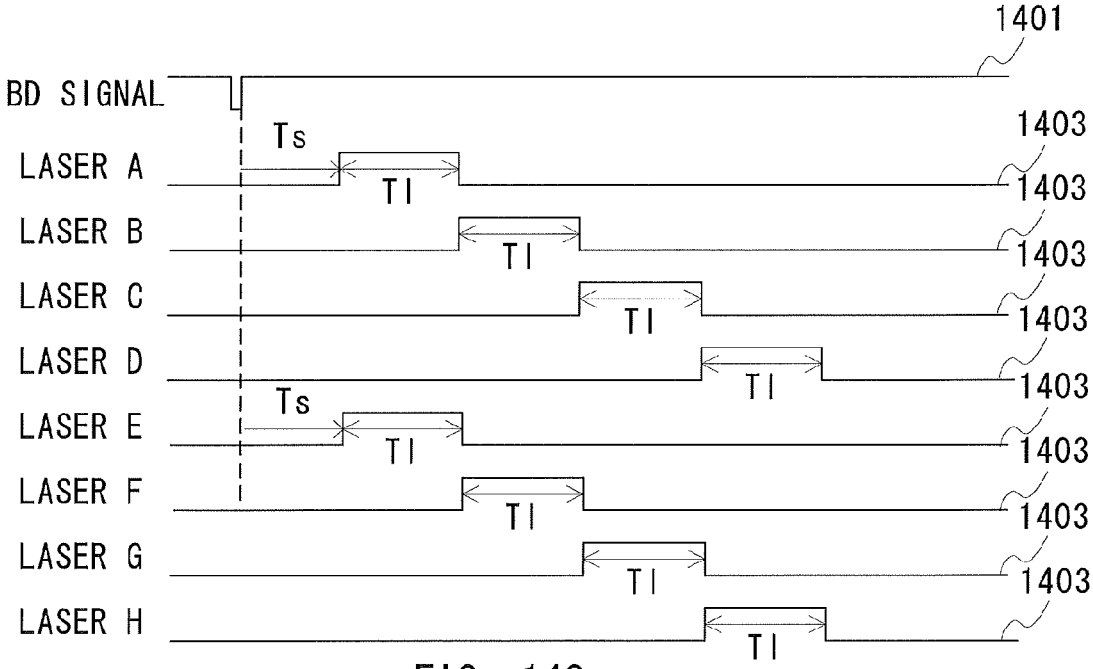

FIG. 14A, FIG. 14B, and FIG. 14C are timing charts for forming the test images illustrated in FIG. 13. The timing chart of FIG. 14A illustrates the relation of light emission 1402 of each laser beam to a BD signal 1401 that is observed when test images are formed in the test image regions 1301 to 1304 with the laser beam A, the laser beam B, the laser beam C, and the laser beam D.

The control unit 201 turns on the laser beam A after a time Ts elapses since the input of the BD signal. When a time Tl further elapses, the control unit 201 turns off the laser beam A and, at the same time, turns on the laser beam B. When the time Tl elapses subsequently, the control unit 201 turns off the laser beam B and, at the same time, turns on the laser beam C. When another time Tl elapses, the control unit 201 turns off the laser beam C and, at the same time, turns on the laser beam D. After the subsequent elapse of the time Tl, the control unit 201 turns off the laser beam D.

Similarly, the timing chart of FIG. 14B illustrates the relation of the light emission 1402 of each laser beam to the BD signal 1401 that is observed when test images are formed in the test image regions 1305 to 1308 with the laser beam E, the laser beam F, the laser beam G, and the laser beam H.

The control unit 201 turns on the laser beam E after a time Ts elapses since the input of the BD signal. When a time Tl further elapses, the control unit 201 turns off the laser beam E and, at the same time, emits the laser beam F. When the time Tl elapses subsequently, the control unit 201 turns off the laser beam F and, at the same time, emits the laser beam G. When another time Tl elapses, the control unit 201 turns off the laser beam G and, at the same time, emits the laser beam H. After the subsequent elapse of the time Tl, the control unit 201 turns off the laser beam H.

The test images by single exposure are thus formed.

The timing chart of FIG. 14C is the same as the timing chart of the first embodiment, and hence a description thereof is omitted.

Figure 15:
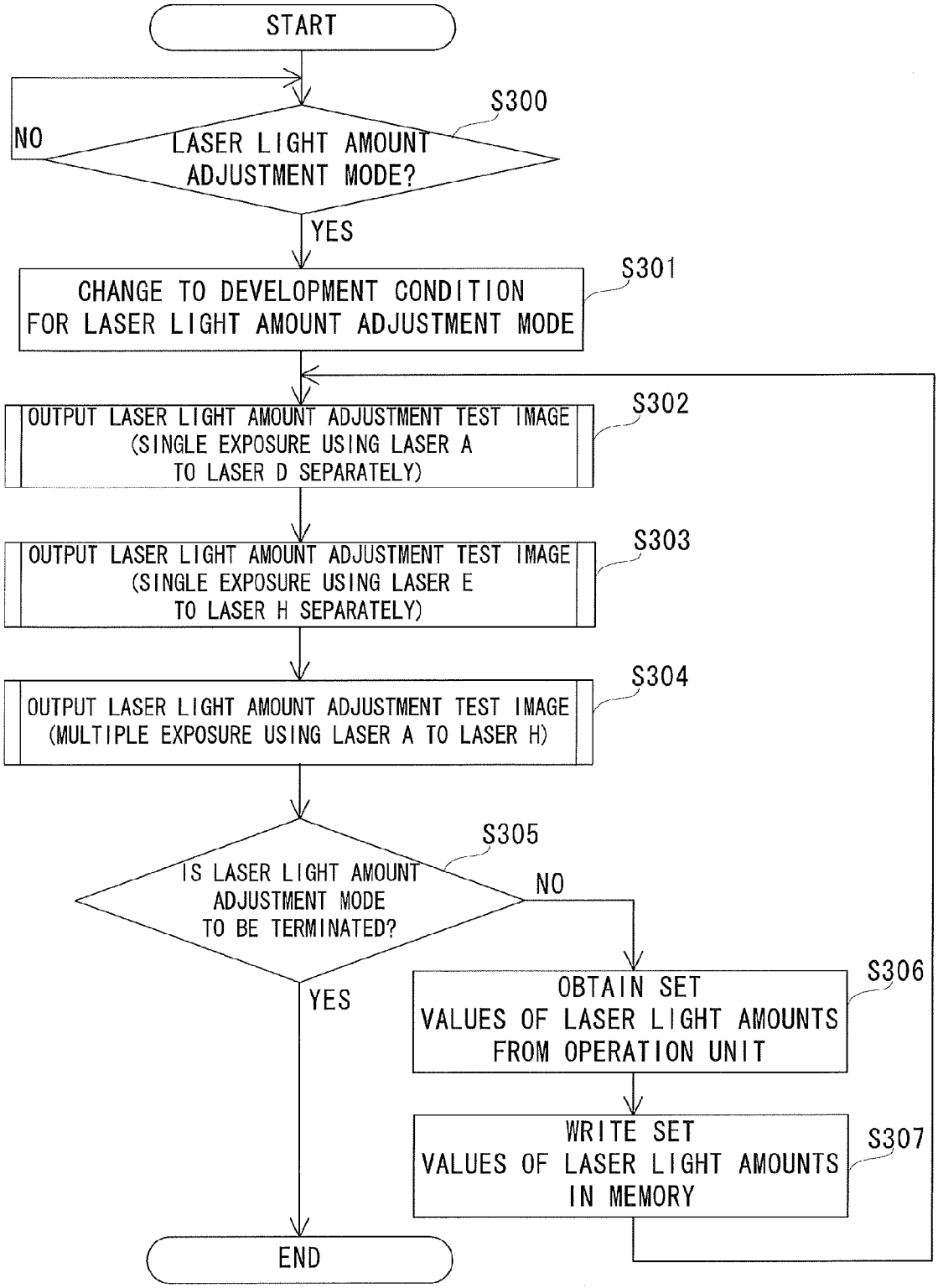
FIG. 15 is a flow chart for processing of outputting a laser light amount adjustment test image.

A method of forming the test images of FIG. 13 is described next. FIG. 15 is a flow chart for processing of outputting a test image.

The control unit 201 first determines whether or not the user has operated the operation unit 14 to select the laser light amount adjustment mode (Step S300). In the case where the laser light amount adjustment mode has been selected (Step S300: Y), the control unit 201 changes development conditions, which are described later, for the laser light amount adjustment mode (Step S301). The control unit 201 then executes processing of outputting a laser light amount adjustment test image (single exposure that uses the laser beam A to the laser beam D separately) (Step S302). The control unit 201 next executes processing of outputting a laser light amount adjustment test image (single exposure that uses the laser beam E to the laser beam H separately) (Step S303), and then executes processing of outputting a laser light amount adjustment test image (multiple exposures that uses the laser beam A to the laser beam H) as well (Step S304).

Thereafter, the control unit 201 determines whether or not terminating the laser light amount adjustment mode has been selected (Step S305). In the case where the laser light amount adjustment mode is to be terminated (Step S305: Y), the control unit 201 ends the laser light amount adjustment mode.

In the case where terminating the laser light amount adjustment mode has not been selected (Step S305: N), laser light amount set values are obtained from the operation unit 14 (Step S306). The operation unit 14 writes the obtained set values of the laser light amounts in the memory 401 (Step S307) and proceeds to Step S302.

In this case, whether to end the laser light amount adjustment mode is determined by the user by, for example, visually checking a test image printed on the recording medium 308. The user chooses to terminate the laser light amount adjustment mode when image density is approximately uniform in the test images that are formed separately with the respective lasers and the density is uniform throughout the test images that are formed by multiple exposures. There are also cases where the density is uniform throughout the test images formed by multiple exposures but the test images that are formed separately with the respective laser beams do not have a uniform density. In such cases, the laser light amount adjustment mode is continued to change, via the operation unit 14, the set values of the amounts of light of the respective lasers in accordance with the image densities of the test images formed separately with the respective lasers.

Figure 16:
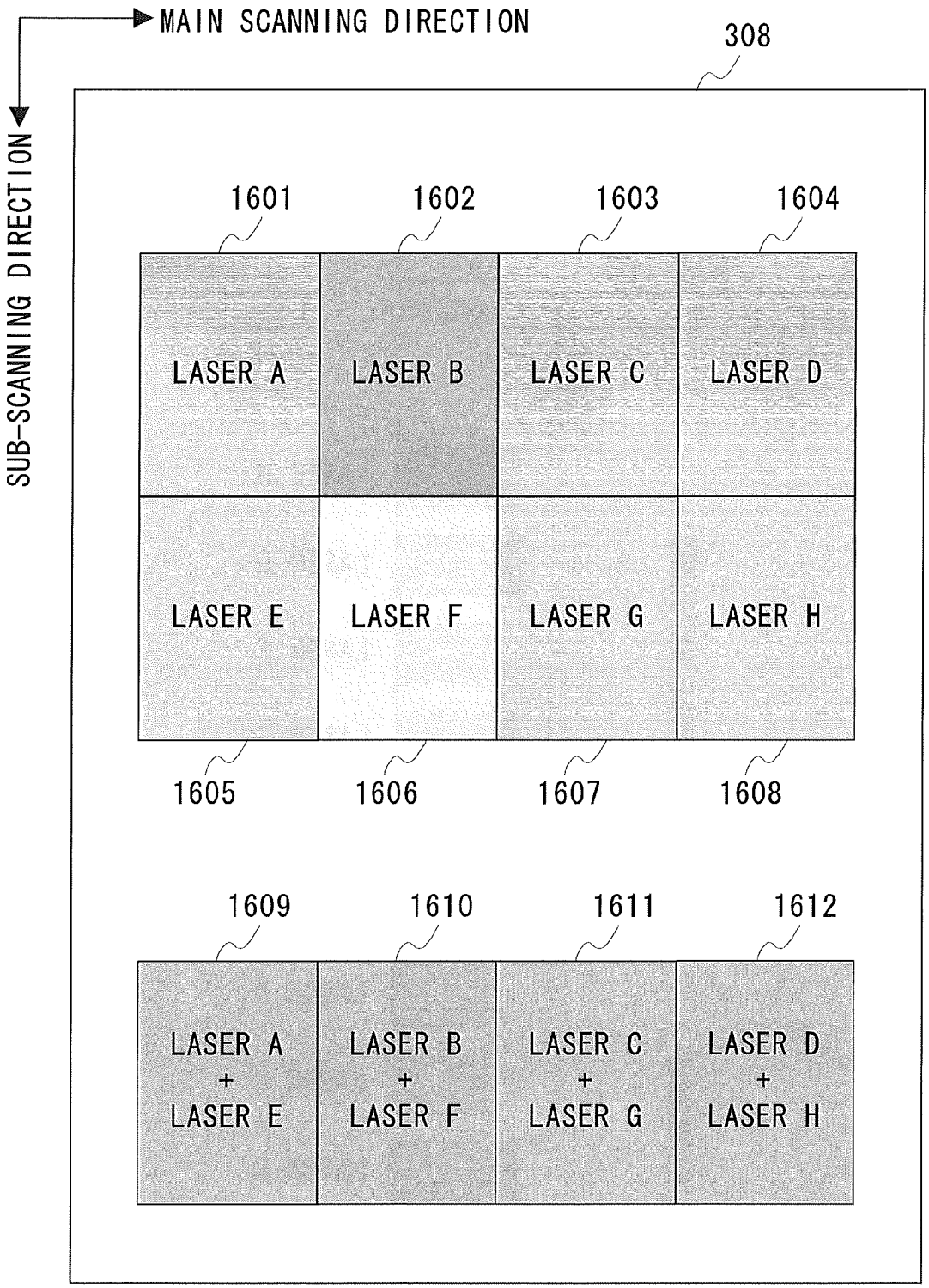
FIG. 16 is a diagram that gives an exemplification of a test image.

A concrete example of such cases is a test image of FIG. 16 in which test image regions 1609 to 1612 formed by multiple exposures have a uniform density, but there is density unevenness in test image regions 1601 to 1608 formed by single exposure. The set values of the amounts of light of the respective laser beams are changed in this case because the difference in the amount of light among the laser beams results in fluctuations in lifetime among the laser beams.

Figure 17:
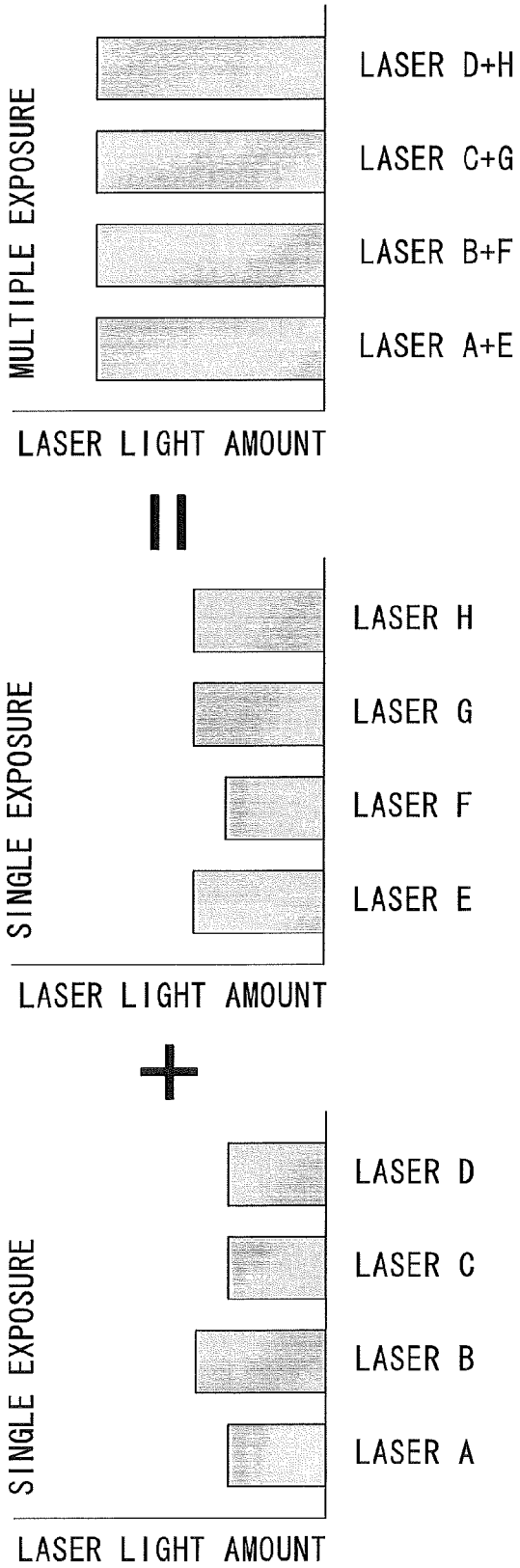
FIG. 17 is a graph showing an example of a relation between the amounts of light of respective lasers and a combined amount of light that is obtained by combining the amounts of laser light.
Figure 18:
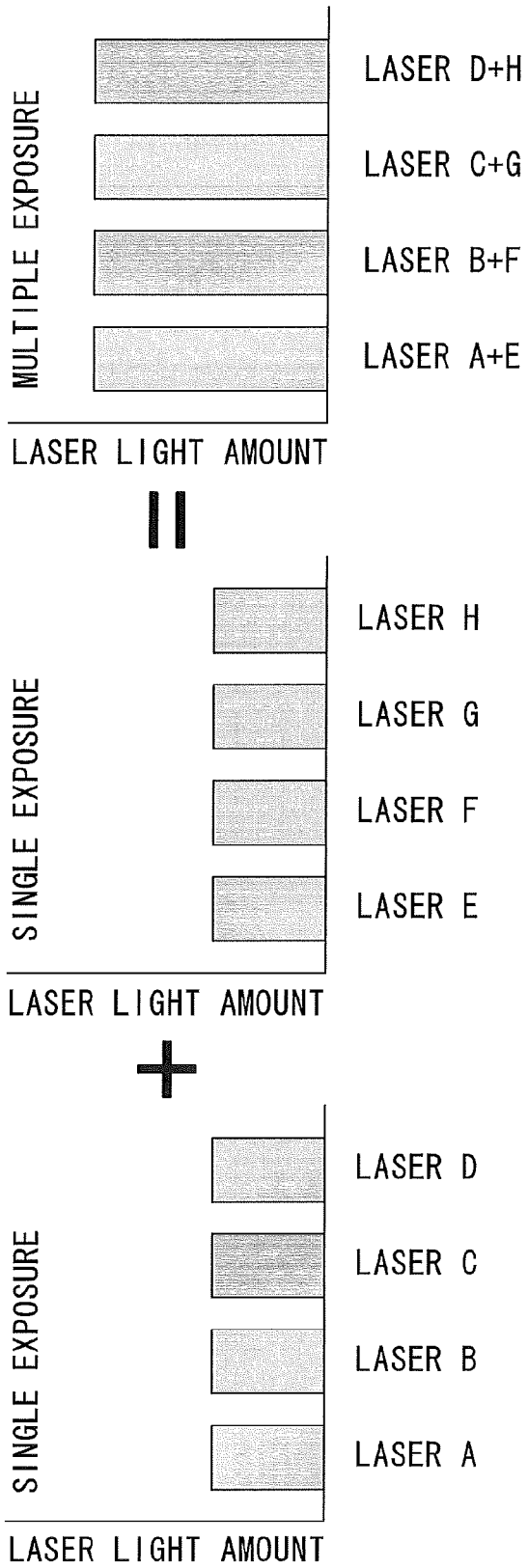
FIG. 18 is a graph showing an example of a relation between the amounts of light of respective lasers and a combined amount of light that is obtained by combining the amounts of laser light.
Figure 19:
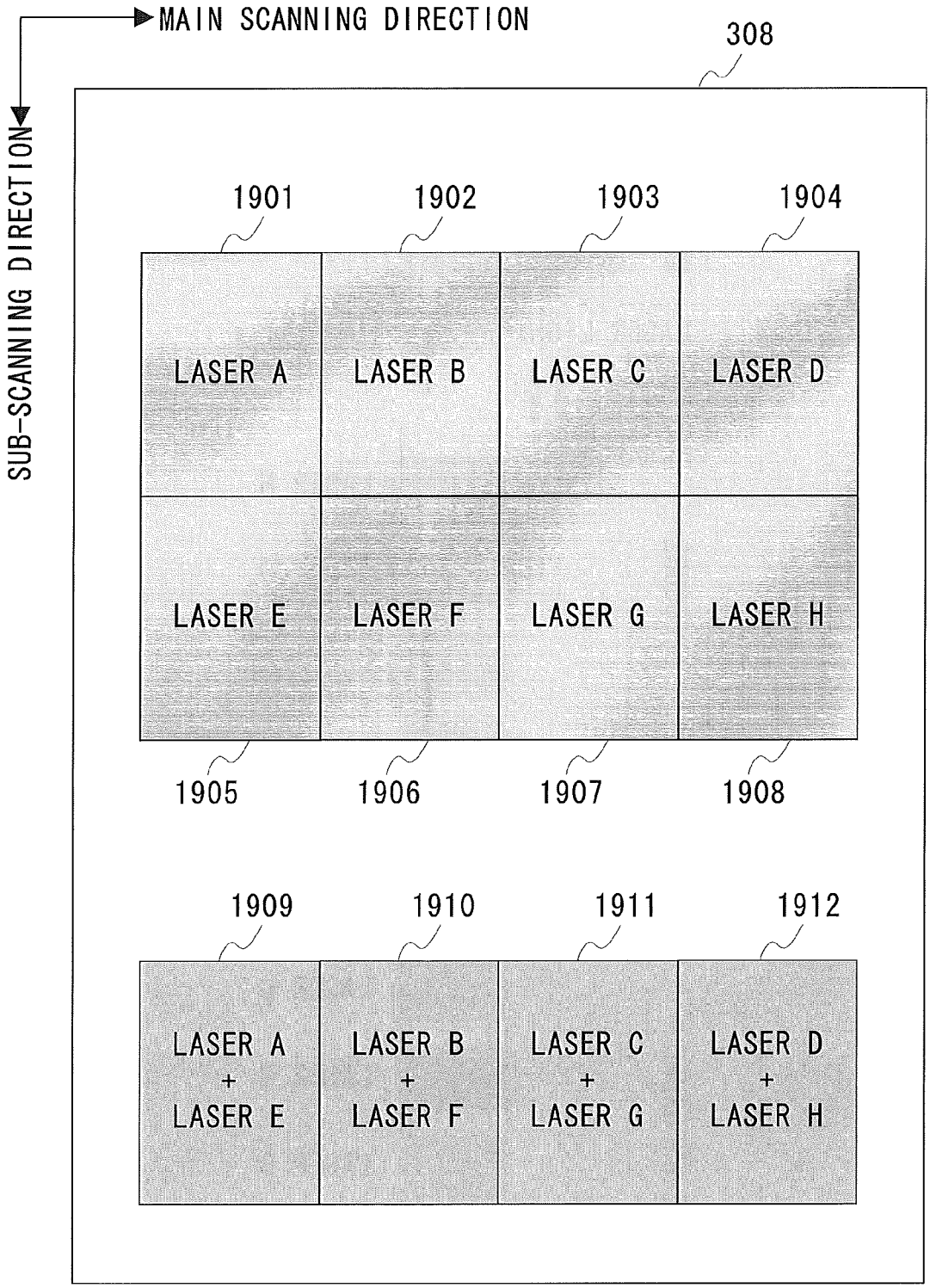
FIG. 19 is a diagram that gives an exemplification of a test image.

FIG. 17 is an example of a graph of the amounts of laser light that correspond to images in the test image illustrated in FIG. 16 and combined amounts of light. FIG. 17 illustrates a relation among the amounts of light of the laser beam A to the laser beam D in single exposure, the amounts of light of the laser beam E to the laser beam H in single exposure, and the amounts of light in multiple exposures which is a result of combining the former two. In this example, while the combined amounts of light are uniform in multiple exposures, the laser beam B is large and the laser beam F is small in the amount of light. The user therefore operates the operation unit 14 to make an adjustment in which the amount of light of the laser beam B is reduced and the amount of light of the laser beam F is increased, while keeping the combined amounts of light in multiple exposures uniform. As a result, the set values no longer cause a difference in the amount of light among the laser beams as illustrated in FIG. 18, which is an example of a graph of the amounts of laser light and the combined amounts of laser light, and hence density unevenness is eliminated as in a test image illustrated in FIG. 19.

Figure 20:
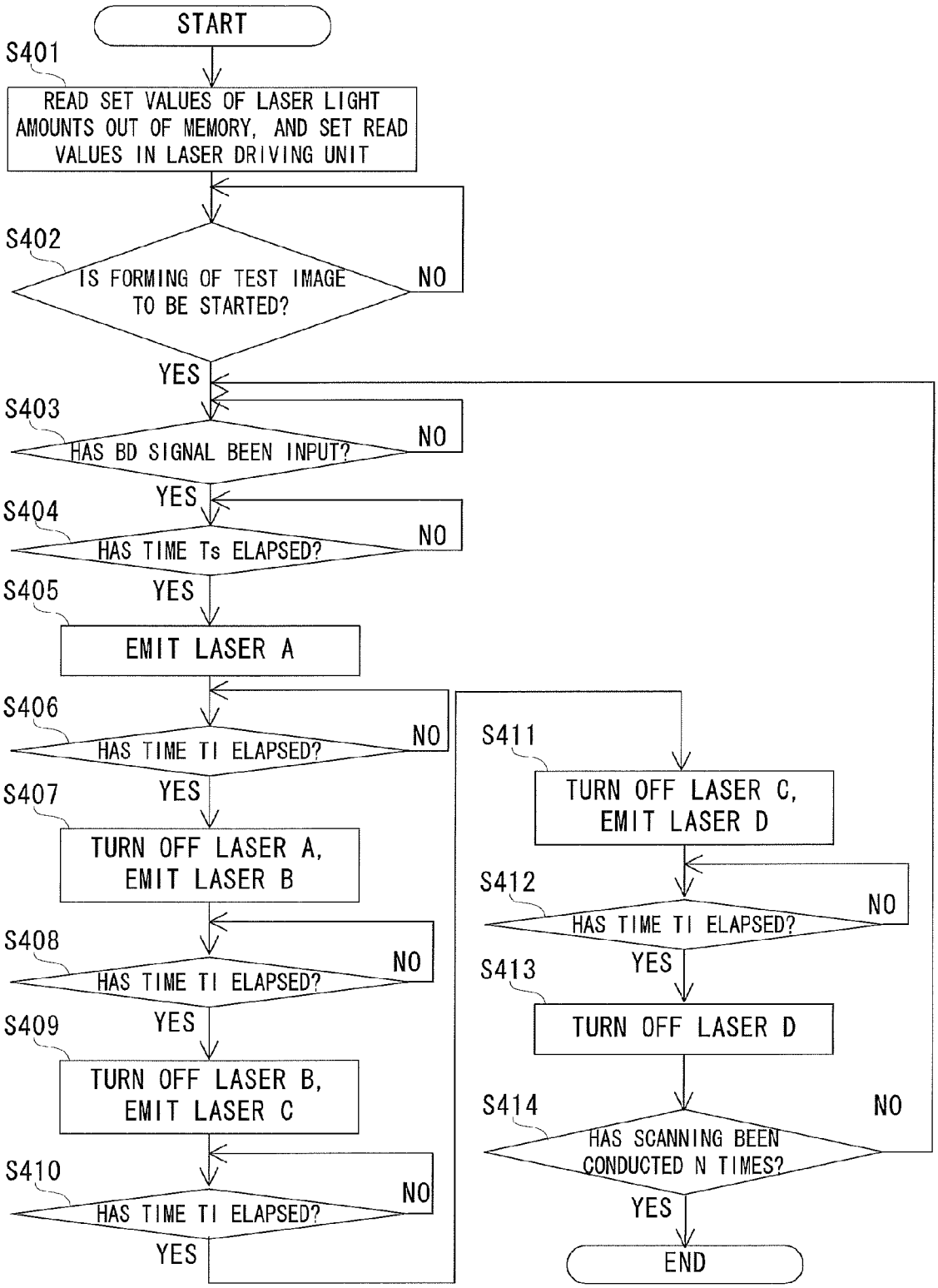
FIG. 20 is a flow chart for processing of outputting a laser light amount adjustment test image.

Described next with reference to FIG. 20 is a procedure example of the processing of outputting a laser light amount adjustment test image (single exposure that uses the laser beam A to the laser beam D separately) of Step S302. A procedure example of the processing of outputting a laser light amount adjustment test image (single exposure that uses the laser beam E to the laser beam H separately) of Step S303 is also described with reference to FIG. 21. The specifics of the processing of outputting a laser light amount adjustment test image (multiple exposures that uses the laser beam A to the laser beam H) of Step S304 are the same as those illustrated in the flow chart of the first embodiment, and hence a description thereof is omitted.

FIG. 20 is an explanatory diagram illustrating an example of the processing procedure for outputting a laser light amount adjustment test image (single exposure that uses the laser beam A to the laser beam D separately) of Step S302.

In the processing of Step S302, the control unit 201 first reads set values of the amounts of laser light out of the memory 401 and sets the read values in the laser driving unit 202 (Step S401). The control unit 201 next determines whether to start the forming of a test image (Step S402). In the case where the image forming is to be started (Step S402: Y), the control unit 201 waits for an input of a BD signal (Step S403). When a BD signal is input (Step S403: Y) and after the time Ts elapses (Step S404: Y), the laser beam A is emitted out of the plurality of laser beams (Step S405).

Thereafter, the control unit 201 waits for the elapse of the time Tl (Step S406: Y), and switches the emitting lasers by turning off the laser beam A so that the laser beam B is emitted (Step S407). The control unit 201 subsequently waits for the elapse of another time Tl (Step S408: Y), and switches the emitting lasers by turning off the laser beam B so that the laser beam C is emitted (Step S409). The control unit 201 further waits for the elapse of the time Tl (Step S410: Y), and switches the emitting lasers by turning off the laser beam C so that the laser beam D is emitted (Step S411). The control unit 201 once again waits for the elapse of the time Tl (Step S412: Y), and turns off the laser beam D (Step S413).

Then, the control unit 201 determines whether the image processing apparatus has finished conducting scanning N times (Step S414). For instance, when the sub-scanning size of the test image is equivalent to 200 scans, N is "200". In the case where the image processing apparatus has not finished conducting scanning N times (Step S414: N), the control unit 201 returns to Step S403 to execute Steps S403 to S413, and executes scanning processing once more. On the other hand, in the case where the image processing apparatus has finished conducting scanning N times (Step S414: Y), the processing of outputting a laser light amount adjustment test image (single exposure that uses the laser beam A to the laser beam D separately) of Step S302 is finished.

The test image is formed in the manner described above. The user corrects the amounts of light of the respective lasers by viewing the output test image.

Figure 21:
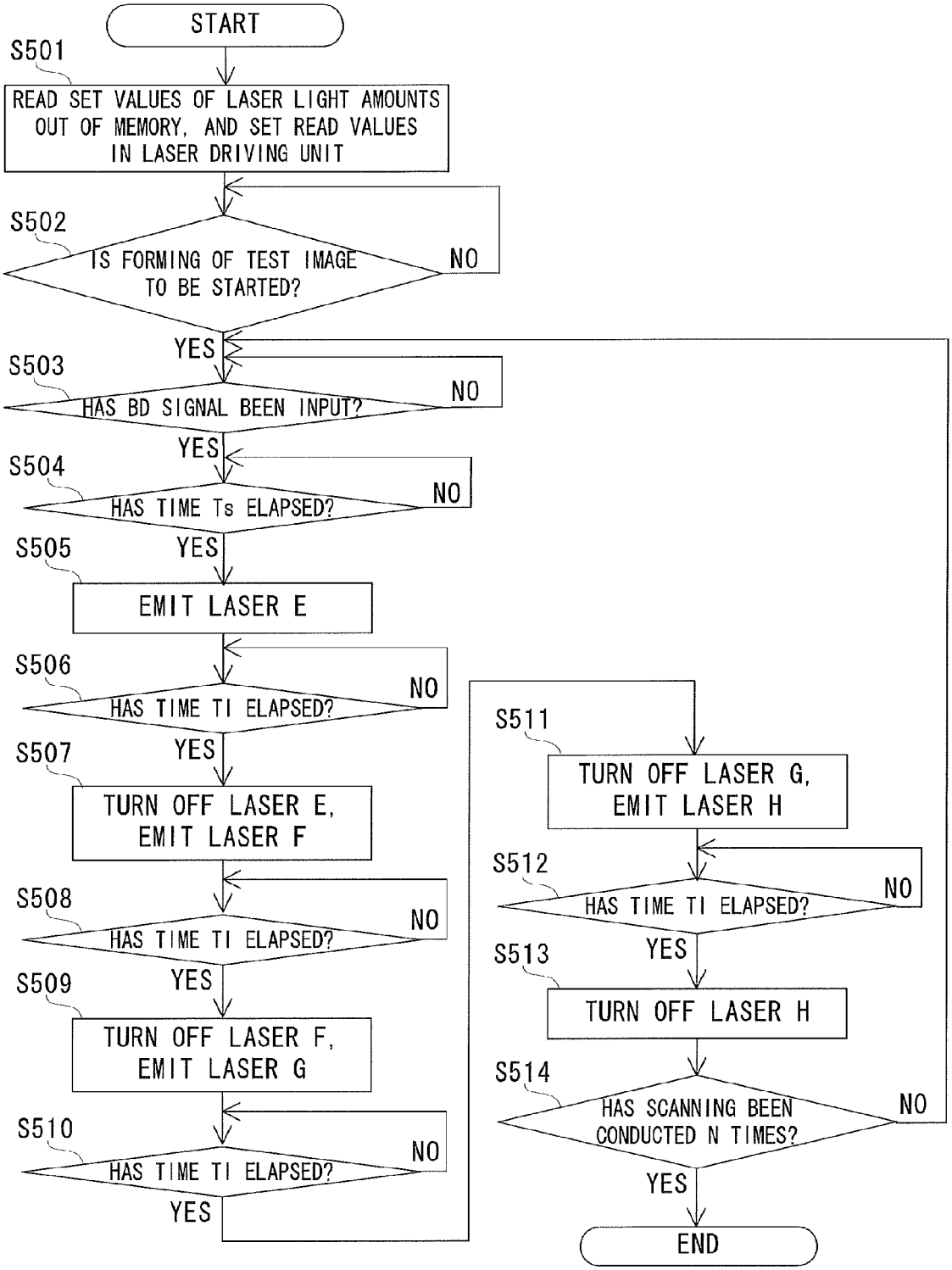
FIG. 21 is a flow chart for processing of outputting a laser light amount adjustment test image.
Figure 22:
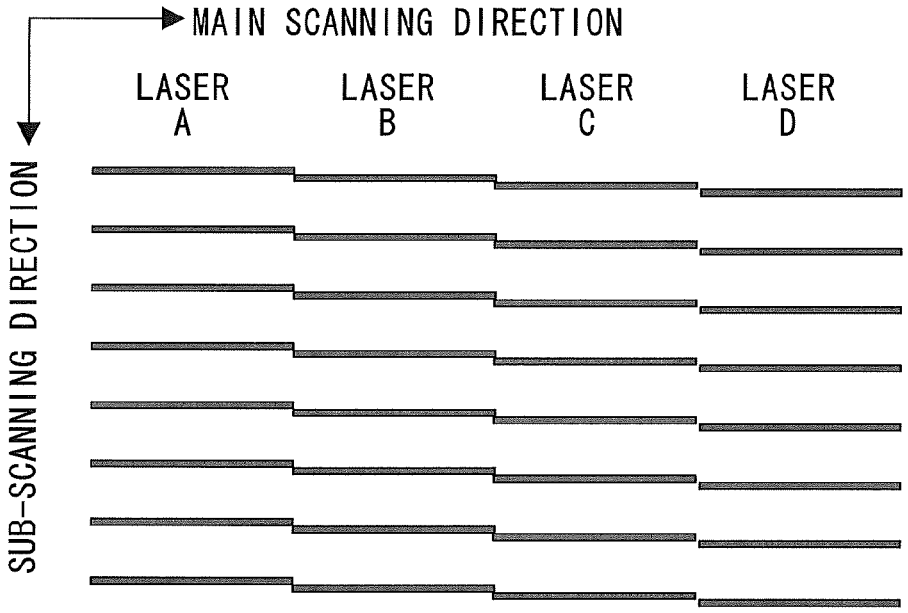
FIG. 22 is a diagram that gives an exemplification of scanning of test image regions.
Figure 23:
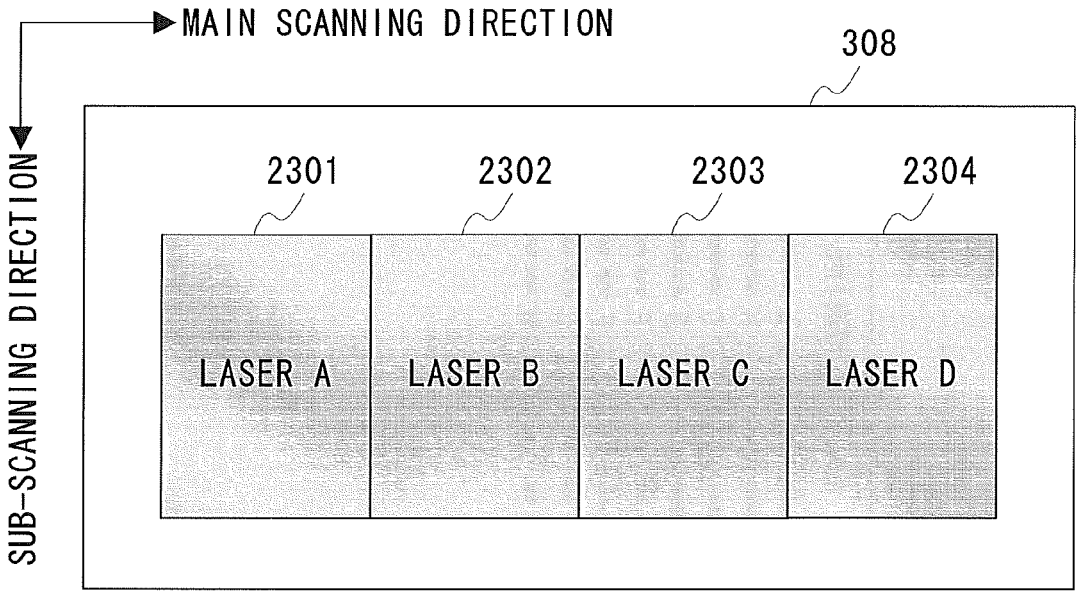
FIG. 23 is a diagram that gives an exemplification of a test image.

FIG. 21 is an explanatory diagram illustrating an example of the processing procedure for outputting a laser light amount adjustment test image (single exposure that uses the laser beam E to the laser beam H separately) of Step S303.

In the processing of Step S303, the control unit 201 first reads set values of the amounts of laser light out of the memory 401 and sets the read values in the laser driving unit 202 (Step S501). The control unit 201 next determines whether to start the forming of a test image (Step S502). In the case where the image forming is to be started (Step S502: Y), the control unit 201 waits for an input of a BD signal (Step S503). When a BD signal is input (Step S503: Y) and after the time Ts elapses (Step S504: Y), the laser beam E is emitted out of the plurality of laser beams (Step S505).

Thereafter, the control unit 201 waits for the elapse of the time Tl (Step S506: Y), and switches the emitting lasers by turning off the laser beam E so that the laser beam F is emitted (Step S507). The control unit 201 subsequently waits for the elapse of another time Tl (Step S508: Y), and turns off the laser beam F so that the laser beam G is emitted (Step S509). The control unit 201 further waits for the elapse of the time Tl (Step S510: Y), and turns off the laser beam G so that the laser beam H is emitted (Step S511). The control unit 201 once again waits for the elapse of the time Tl (Step S512: Y), and turns off the laser beam H (Step S513).

The control unit 201 determines whether or not the image processing apparatus has finished conducting scanning N times (Step S514). For instance, when the sub-scanning size of the test image is equivalent to 200 scans, N is "200". In the case where the image processing apparatus has not finished conducting scanning N times (Step S514: N), the control unit 201 returns to Step S503 to execute Steps S503 to S513, and executes scanning processing once more. On the other hand, in the case where the image processing apparatus has finished conducting scanning N times (Step S514: Y), the processing of outputting a laser light amount adjustment test image (single exposure that uses the laser beam E to the laser beam H separately) of Step S303 is finished.

The test image is formed in the manner described above. The user corrects the amounts of light of the respective lasers by viewing the output test image.

The test image output in this embodiment is formed to have the line width of one laser beam as illustrated in the enlarged view 1313 of the test image of FIG. 13, which does not form a satisfactory latent image. Consequently, some test images that are output do not have the same density as in the forming of a normal image. This embodiment obtains the same image density as in the forming of a normal image by changing development conditions for the forming of a test image.

Specifically, when the exposure potential is 200 V, the development bias potential is 400 V, and the charge potential is 600 V in the forming of a normal image, a development V contrast potential difference Vcont is 200 V. The development V contrast potential difference Vcont is a potential difference between the exposure potential and the development bias potential. A latent image for forming a test image has the line width of one laser beam, and the exposure potential in the forming of a test image is, for example, 300 V, unlike the exposure potential in the forming of a normal image. Therefore, in order to obtain the same development V contrast potential difference Vcont (=200 V) as in the forming of a normal image, the development bias potential is changed to 500 V before a test image is formed.

As described above, according to this embodiment, test images formed with respective laser beams can be arranged in a regular pattern irrespective of density unevenness due to an optical system or a photoreceptor. This enables the user to check for density unevenness in an image due to laser light, and to adjust the amounts of light of the respective laser beams so that the density unevenness is suppressed. The density unevenness is thus reduced.

The test images of the embodiments described above are merely examples, and the scope of the present invention is not limited to the exemplifications given in the above.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-096802, filed Apr. 20, 2012, which is hereby incorporated by reference herein in its entirety.

What is claimed is:

1. An image forming apparatus, comprising:

a photoreceptor to be driven to rotate;

an optical scanning device comprising:

a light source that comprises a first light emitting element which emits a first light beam, a second light emitting element which emits a second light beam, a third light emitting element which emits a third light beam, and a fourth light emitting element which emits a fourth light beam; and a deflection unit configured to deflect the first light beam, the second light beam, the third light beam, and the fourth light beam so that the first light beam, the second light beam, the third light beam, and the fourth light beam scan the photoreceptor, wherein the first light beam and the third light beam form, on the photoreceptor, a first electrostatic latent image corresponding to a first pixel, and the second light beam and the fourth light beam form, on the photoreceptor, a second electrostatic latent image corresponding to a second pixel which is different from the first pixel;

an image forming unit configured to develop, with a toner, the first electrostatic latent image and the second electrostatic latent image formed on the photoreceptor by exposing the photoreceptor with the first light beam, the second light beam, the third light beam, and the fourth light beam, and which transfers the toner image formed on the photoreceptor onto a recording medium; and a control unit configured to control the optical scanning device to form the first electrostatic latent image corresponding to a first test image and the second electrostatic latent image corresponding to a second test image to be formed on the photoreceptor such that the first test image and the second test image are respectively formed in different places on an identical recording medium, wherein the first electrostatic latent image corresponding to the first test image is formed by a plurality of scans with the third light beam and the first light beam deflected by the deflection unit, and when forming the first electrostatic latent image corresponding to the first test image, the photoreceptor is not exposed with the second light beam and the fourth light beam, wherein the second electrostatic latent image corresponding to the second test image is formed by a plurality of scans with the second light beam and the fourth light beam deflected by the deflection unit, and when forming the second electrostatic latent image, the photoreceptor is not exposed with the first light beam and the third light beam.

2. An image forming apparatus according to claim 1, wherein the optical scanning device forms a first sub-electrostatic latent image with the first light beam, forms a second sub-electrostatic latent image with the second light beam, forms a third sub-electrostatic latent image with the third light beam, and forms a fourth sub-electrostatic latent image with the fourth light beam, and wherein the control unit controls the optical scanning device so that a first sub-test image, which is formed by developing the first sub-electrostatic latent image, a second sub-test image, which is formed by developing the second sub-electrostatic latent image, a third sub-test image, which is formed by developing the third sub-electrostatic latent image, and a fourth sub-test image, which is formed by developing the fourth sub-electrostatic latent image, are formed in different places on the identical recording medium.

3. An image forming apparatus according to claim 2, further comprising a condition setting unit configured to set a condition for forming one of the test images and the sub-test images differently from a condition for forming images other than the test images and the sub-test images.

4. An image forming apparatus according to claim 3, further comprising a light amount adjusting unit configured to individually increase or decrease amounts of light of the first light emitting element, the second light emitting element, the third light emitting element, and the fourth light emitting element based on one of the test images and the sub-test images.

5. A test image forming method, comprising:

forming first electrostatic latent image corresponding to a first pixel, on a photoreceptor which is driven to rotate, by exposing the photoreceptor with a first light beam emitted from a first light emitting element and a third light beam emitted from a third light emitting element;

forming second electrostatic latent image correspond to a second pixel which is different to the first pixel formed with the first light beam and the third light beam, on the photoreceptor in a place different from a place where the first electrostatic latent images are formed, by exposing the photoreceptor with a second light beam emitted from a second light emitting element and a fourth light beam emitted from a fourth light emitting element;

developing, with a toner, the first electrostatic latent image and the second electrostatic latent image which are formed on the photoreceptor; and transferring the toner image formed on the photoreceptor onto a recording medium so that a first test image, which is formed by developing the first electrostatic latent image, and a second test image, which is formed by developing the second electrostatic latent image, are formed on an identical recording medium in a manner that allows comparison between the first test image and the second test image;

wherein the first electrostatic latent image is formed by a plurality of scans with the first light beam and the third light beam while the photoreceptor is not exposed with the second light beam and the fourth light beam; and wherein the second electrostatic latent image is formed by a plurality of scans with the second light beam and the fourth light beam while the photoreceptor is not exposed with the first light beam and the third light beam.

6. A test image forming method according to claim 5, further comprising:

forming a first sub-electrostatic latent image on the photoreceptor by exposing the photoreceptor in a plurality of scans to the first light beam which is emitted from the first light emitting element;

forming a second sub-electrostatic latent image on the photoreceptor by exposing the photoreceptor in a plurality of scans to the second light beam which is emitted from the second light emitting element;

forming a third sub-electrostatic latent image on the photoreceptor by exposing the photoreceptor in a plurality of scans to the third light beam which is emitted from the third light emitting element;

forming a fourth sub-electrostatic latent image on the photoreceptor by exposing the photoreceptor in a plurality of scans to the fourth light beam which is emitted from the fourth light emitting element;

developing, with a toner, the first sub-electrostatic latent image, the second sub-electrostatic latent image, the third sub-electrostatic latent image, and the fourth sub-electrostatic latent image which are formed on the photoreceptor; and transferring the toner images formed on the photoreceptor onto the recording medium so that a first sub-test image, which is created by developing the first sub-electrostatic latent image, a second sub-test image, which is created by developing the second sub-electrostatic latent image, a third sub-test image, which is created by developing the third sub-electrostatic latent image, and a fourth sub-test image, which is created by developing the fourth sub-electrostatic latent image, are formed on an identical recording medium in a manner that allows comparison among the first sub-test image, the second sub-test image, the third sub-test image, and the fourth sub-test image.

* * * * *